US006106060A

United States Patent [19]

Staehlin

[11] Patent Number: 6,106,060

[45] Date of Patent: Aug. 22, 2000

[54] WHEELCHAIR ACCESSIBLE STADIUM SEATING

[75] Inventor: John H. Staehlin, Lutherville, Md.

[73] Assignee: Volunteers for Medical Engineering, Baltimore, Md.

[21] Appl. No.: 09/249,164

[22] Filed: Feb. 12, 1999

Related U.S. Application Data

[63] Continuation-in-part of application No. 09/022,526, Feb. 12, 1998.

[51] Int. Cl.[7] ..... A47C 15/00; F16C 11/00

[52] U.S. Cl. ..... 297/234; 297/242; 403/113

[58] Field of Search ..... 297/232, 240, 297/242, 252, 344.21, 344.22, 257, 248, 234; 248/415, 418, 425; 403/116, 113, 164

[56] References Cited

U.S. PATENT DOCUMENTS

| | | |
|---|---|---|
| 276,830 | 5/1883 | Knight . |
| 636,405 | 11/1899 | Hosmer . |
| 709,286 | 9/1902 | Wilkinson . |
| 941,983 | 11/1909 | Elsner . |
| 941,988 | 11/1909 | Gunn . |
| 1,007,041 | 10/1911 | Miller . |
| 1,015,799 | 1/1912 | Hazen . |
| 1,318,439 | 10/1919 | Erickson . |
| 2,604,925 | 7/1952 | Swift . |
| 3,191,400 | 6/1965 | Swenson . |
| 3,229,940 | 1/1966 | Kagels . |
| 3,275,283 | 9/1966 | Rauch . |
| 3,708,203 | 1/1973 | Barecki et al. . |
| 4,662,679 | 5/1987 | Franck et al. . |
| 5,083,836 | 1/1992 | Beasley . |
| 5,201,567 | 4/1993 | Beasley . |
| 5,299,852 | 4/1994 | Beasley . |

OTHER PUBLICATIONS

Engineering drawing of "Swing Away Chair" of Irwin Seating Co., Grand Rapids, MI, 1 page.

Accessible Products Brochure of American Seating Co., Grand Rapids, MI, 1992, 4 pages.

*Primary Examiner*—Milton Nelson, Jr.

*Attorney, Agent, or Firm*—Finnegan, Henderson, Farabow, Garrett & Dunner, L.L.P.

[57] ABSTRACT

A seating arrangement comprising two seats mounted to a single support pole, each seat capable of being rotated about the support pole and stowed independently of the other. The seating arrangement may also include a single seat slidably and rotatably mounted to a support pole. In one embodiment, the seat may changed from the stowed to the in-use position, or vice versa, by rotating the seat about the support pole, without requiring any upward or downward movement of the seats.

14 Claims, 25 Drawing Sheets

WHEELCHAIR ACCESSIBLE STADIUM SEATING

This application is a Continuation-In-Part of application Ser. No. 09/022,526, filed on Feb. 12, 1998.

BACKGROUND OF THE INVENTION

Seating arrangements at stadiums and other large facilities around the world are primarily designed to accommodate able-bodied persons by using basic fold-down seating configurations. Individuals in wheelchairs are generally limited to sitting in areas allocated for wheelchair use at predetermined locations throughout the stadium. The advent of the Americans with Disabilities Act (ADA), which mandates the scope of the accommodations that must be provided for individuals in wheelchairs, has prompted stadium owners to expand the seating areas for these individuals.

The seating arrangements prevalent in today's newly erected stadiums accommodate wheelchairs by providing individual seats mounted on a single post that fold up and swing away to provide an area between the posts sufficiently large for a wheelchair. This distance, which must be at least thirty-three inches as required by the ADA, dictates the number of seats available in a given row. This configuration requires a minimum separation distance between each post in a given row of seats. Conventional wheelchair accessible stadium seating merely provides sixty-six inches of open space between two folded seats to accommodate two individuals in wheelchairs. Accordingly, these seating configurations must necessarily allow for empty space between the adjacent posts upon which the individual seats are mounted, creating an inefficient waste of space between adjacent posts. As such, the conventional stadium seating fails to maximize the seating space achieved by the current invention.

Moreover, these individual seats are mounted on single posts and are stowed by pivoting the seating area upward and rotating the entire seat about a fixed pivot point. However, because the seat if fixed at the pivot point, the rotated seat encroaches upon the aisle behind where the individuals in wheelchairs are seated.

Conventional handicapped seating has another inherent drawback in that when folded and pivoted away, the seat effectively creates a "wall" or barrier between either the individual in the wheelchair and an individual in a standard seat, or between two individuals, both in wheelchairs.

SUMMARY OF INVENTION

Accordingly, the present invention is directed to a seating system that substantially obviates one or more of the problems due to limitations and disadvantages of the related art. The seating arrangement of the present invention is configured so that two seats mounted on a single post are capable of folding and swinging away, effectively eliminating the wasted space associated with mounting each seat on its own corresponding post. The use of contiguous sets of tandem seats maximizes the number of seats for both individuals in wheelchairs and those using conventional stadium seating.

The additional space created by the tandem seating arrangement allows for installation of more seats in a particular row or an additional sliding seat between sets of tandem seats. Configuring this single seat to have translational and pivotal movement in relation to the post allows this lineal row configuration to accommodate up to fifty percent more seats than the conventional seating design. Additionally, such a configuration allows the single seat, once it is folded and pivoted away, to be further displaced away from the aisle behind where the individuals in wheelchairs are seated. Utilization of the sliding support member in conjunction with the central pivot point on the single support post allows for significant flexibility in seating design.

An additional advantage of one embodiment of the present invention is that it eliminates the obstruction created by conventional folding seats by providing a stadium seat which folds downward, the folded seat resting proximate the individuals' legs, rather than obstructing the individuals' lateral view.

Additional features and advantages of the invention will be set forth in the description which follows, and in part will be apparent from the description, or may be learned by practice of the invention. The objectives and other advantages of the invention will be realized and attained by the apparatus particularly pointed out in the written description and claims hereof as well as the appended drawings.

To achieve these and other advantages and in accordance with the purpose of the invention, as embodied and broadly described, the invention includes a seating arrangement having two seats each having a frame having upper and lower circular flanges; and a circular support pole. The upper and lower flanges of one frame are configured to rest above the upper and lower flanges of the other frame. The flanges are concentric and rotatable about the support pole. The flanges are provided with an indexing and restraining means for independently placing one of the seats in one of an occupied and stowed position independently of the other seat, without requiring any upward or downward movement of the flanges. The detent arrangement has a pair of flexible detent surfaces and an index pin for each frame. The pair of flexible detent surfaces engages the index pin attached to the support pole. Each frame has an annular slot. The annular slot has a first end representing the stowed position of the seat and an opposite end representing the in-use position of the seat. In order to place the seat in either the stowed or inuse position one of the flexible detent surfaces must be deflected out of the path of the index pin, the flexible detent surface thereby maintaining the index pin in its respective position at the respective end of the annular slot.

It is to be understood that the foregoing general description and the following detailed description are exemplary and are intended to provide further explanation of the invention as claimed. The accompanying drawings are included to provide a further understanding of the invention and are incorporated in and constitute a part of this specification, illustrate several embodiments of the invention and together with the description serve to explain the principles of the invention.

DETAILED DESCRIPTION

Reference will now be made in detail to the present preferred embodiments of the invention, examples of which are illustrated in the accompanying drawings.

Figure 1:
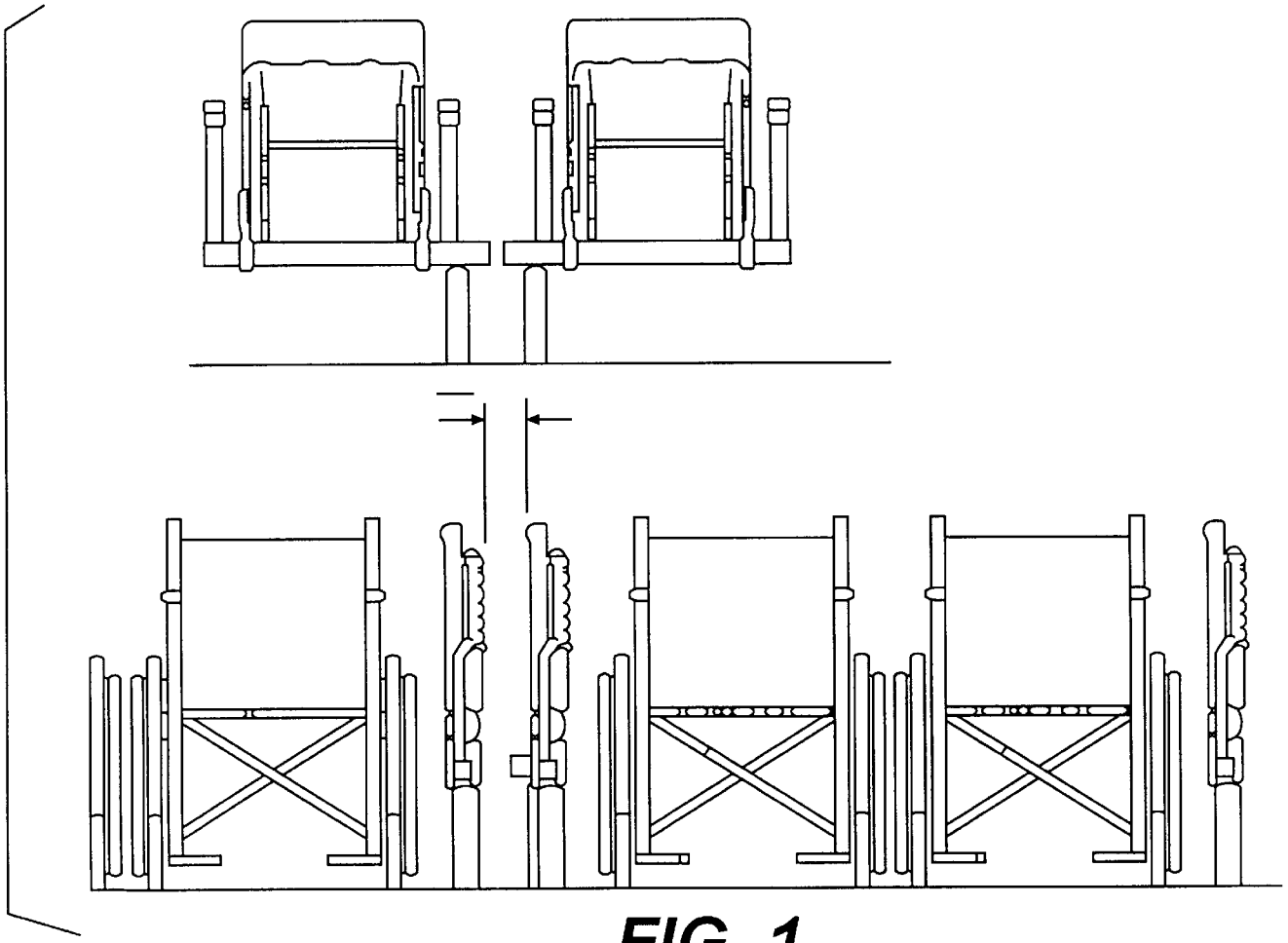
FIG. 1 PRIOR ART
FIG. 1 is a front view illustrating the space saved by the present invention.

As illustrated in FIG. 1, the conventional stadium seat configured to accommodate space for a wheelchair is singly mounted to a support pole. This configuration requires a separation distance (d) between the support poles of each seat. In a lineal role of seats, these separation distances (d) take up considerable valuable space. The exemplary embodiment of the seating system of the present invention is shown in FIG. 2 and is designated generally by reference numeral (5).

Figure 2:
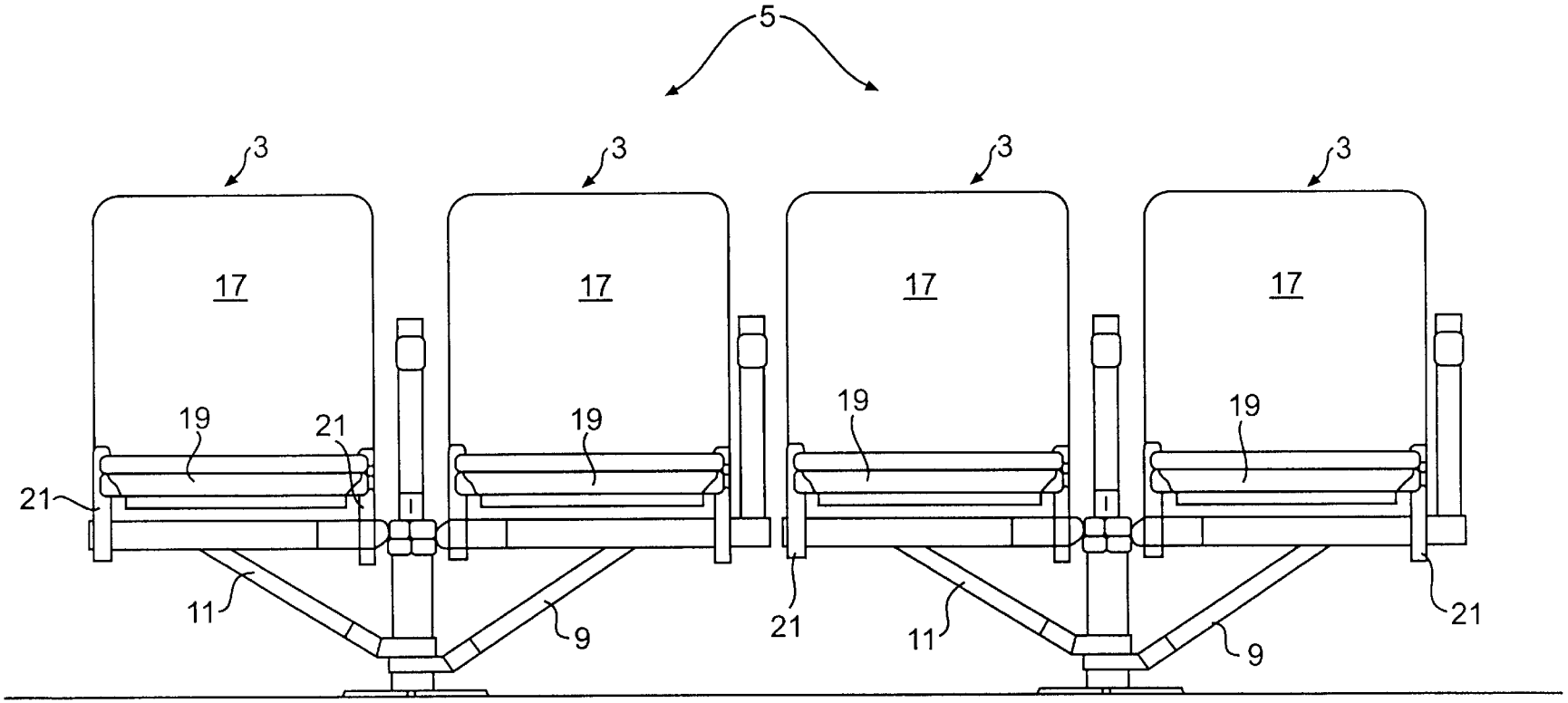
FIG. 2 is a front view of two tandem seat assemblies in series.
Figure 3:
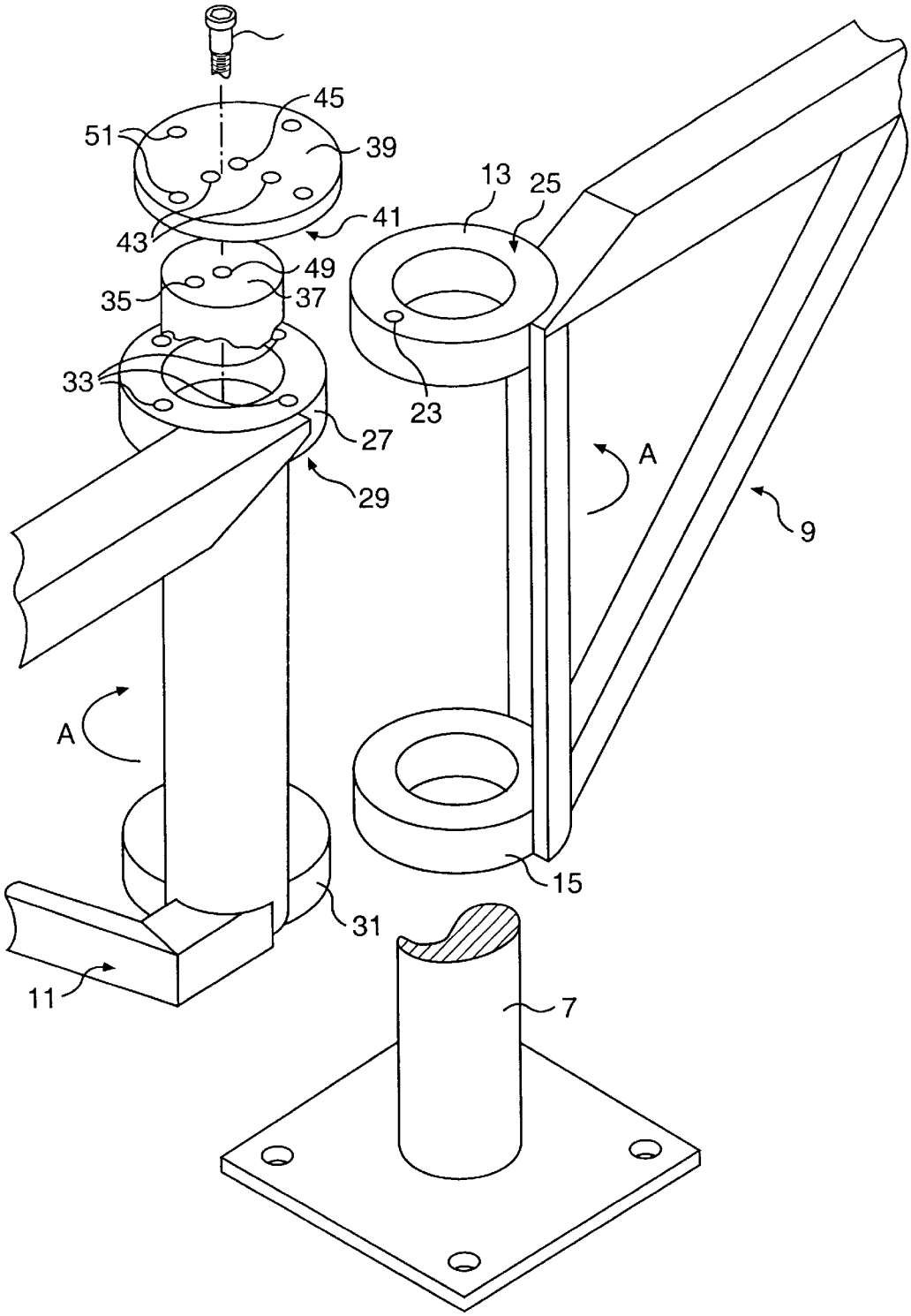
FIG. 3 is an exploded perspective view of two seat frames rotatably and slidably connected to a support pole.
Figure 4:
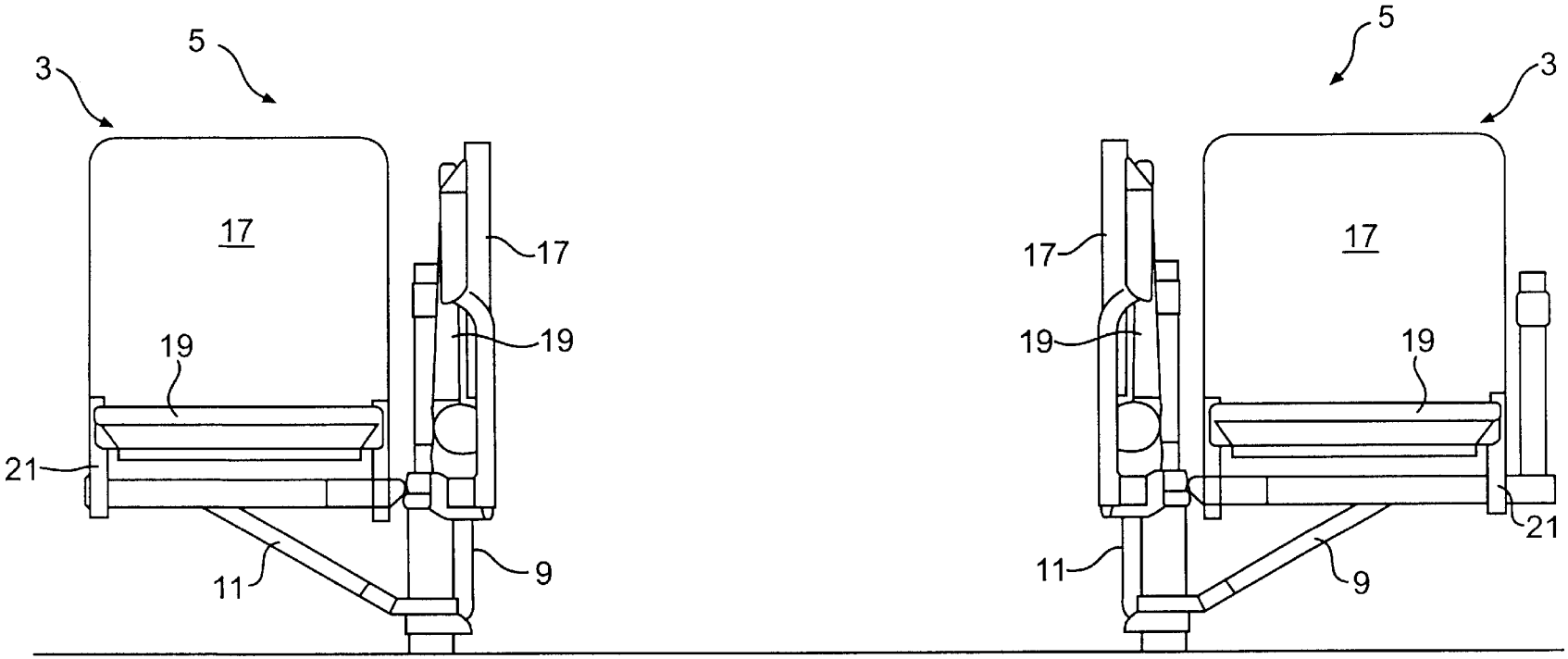
FIG. 4 is a front view of two tandem seat assemblies in series with two seats stowed for wheelchair accessibility.
Figure 5:
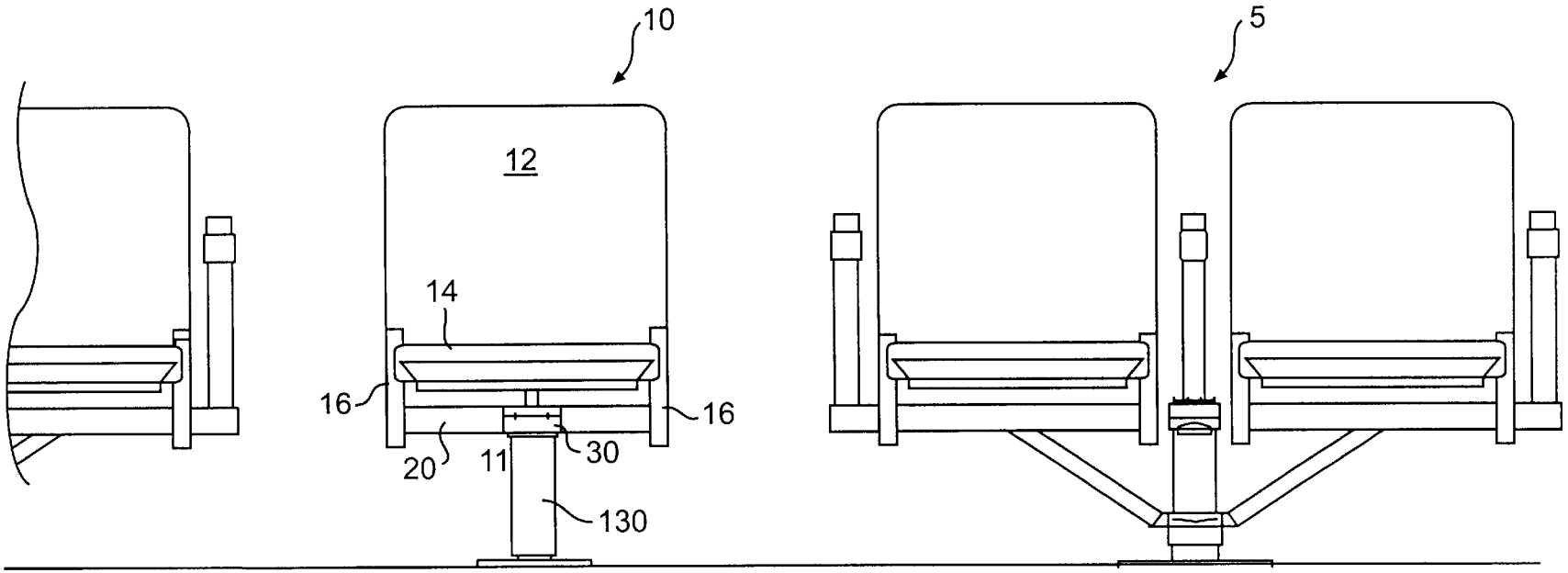
FIG. 5 is a front view of a single seat assembly with a sliding support member used in combination with a tandem seat assembly.

Referring now to FIGS. 2 through 5, a first embodiment of the tandem seat (5) will be described. The tandem seat (5) may be utilized in conjunction with other tandem seats (as shown in FIG. 2) or with a single seat (as shown in FIG. 5). The tandem seat (5) includes two seats (3) connected to a support pole (7). Each seat (3) has a seat back (17) and a folding seat portion (19). Each seat (3) is supported by right and left frames (9, 11), respectively. The seats (3) are connected to the frames (9, 11) by seat brackets (21).

Referring now to FIG. 3, the right frame (9) has an upper right flange (13) and a lower right flange (15). The upper right flange (13) has a flange dowel pin (23) on the top surface (25) thereof. The left frame (11) has an upper left flange (27) and a lower left flange (31). The underside (29) of the upper left flange (27) has three apertures (33), each sized to receive the flange dowel pin (23). The apertures (33) are positioned such that when the flange dowel pin (23) engages one of the apertures (33), the left frame (11) and the right frame (9) are oriented at either a 180° (as illustrated in FIG. 2), a 90° (as illustrated in FIG. 4), or a 0° angle (both seats stowed (not shown)) with respect to one another, depending on which aperture (33) the flange dowel pin (23) engages. Each flange (13, 15, 27, 31) is sized to be concentric about the support pole (7). The support pole (7) has a pole dowel pin (35) and a threaded hole (49) on its top surface (37). As best shown in FIG. 3, the underside (29) of the upper left flange (27) contacts the top surface (25) of the upper right flange (13). The lower left flange (31) rests atop the lower right flange (15). A cover plate (39) is bolted to the top surface of the left frame (11) and releasably engages the top surface of the support pole (7) to hold the left and right frames (9, 11) (and the seats (3) affixed thereto) in position. The lower surface (41) of the cover plate (39) has dowel bores (43) sized to engage the pole dowel pin (35). Extending through the cover plate (39) is a shoulder bolt hole (45) as well as bolt holes (51).

Referring now to FIG. 2, when in use, the left and right frames (9, 11) of the tandem seats (5) are oriented 180° with respect to one another. Either seat (3) may be stowed independently or both seats (3) may be stowed simultaneously. The seats (3) are placed in their compact configuration as follows. The left frame (11) is raised upwardly a distance defined by the length of the shoulder bolt (47). This distance is long enough for the flange dowel pin (23) to disengage one of the three holes (33) on the underside (29) of the top left flange (27) and for the pole dowel pin (35) to disengage on of the dowel bores (43) on the lower surface (41) of the cover plate (39). Once the left frame (11) is raised a distance sufficient to disengage the dowel pins (23, 35), the left frame (11) and the right frame (9) may pivot freely, independent of one another, as indicated by Arrow A in FIG. 3. The left and right frames (11, 9) may be rotated from a position where the left and right frames (11, 9) assume a 180° orientation with respect to one another (when the seats are in use) to a 90° orientation with respect to one another, or both frames may be stowed, assuming a 0° orientation with respect to one another (to accommodate a wheelchair). To assume one of these desired orientations, the flange dowel pin (23) engages one of the three holes (33) on the underside (29) of the top left flange (27) and the pole dowel pin (35) engages one of the dowel bores (43) on the lower surface (41) of the cover plate (39). The three holes (33) and the dowel bores (43) are positioned to accommodate various angular orientations and to lock frames (9, 11) in predetermined locations.

Figure 6:
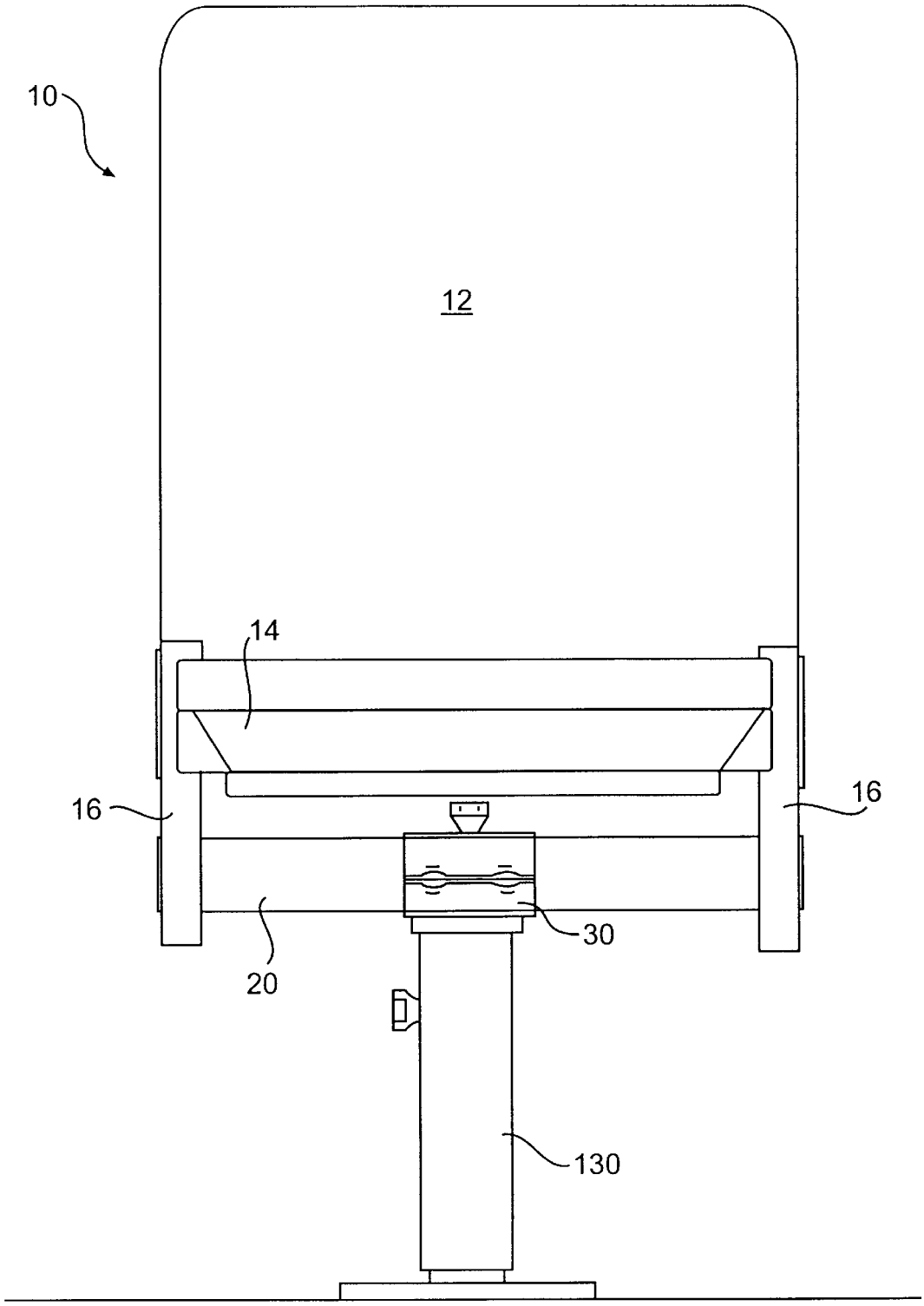
FIG. 6 is a front view of a single seat assembly with the seat centered on a sliding support member.
Figure 7:
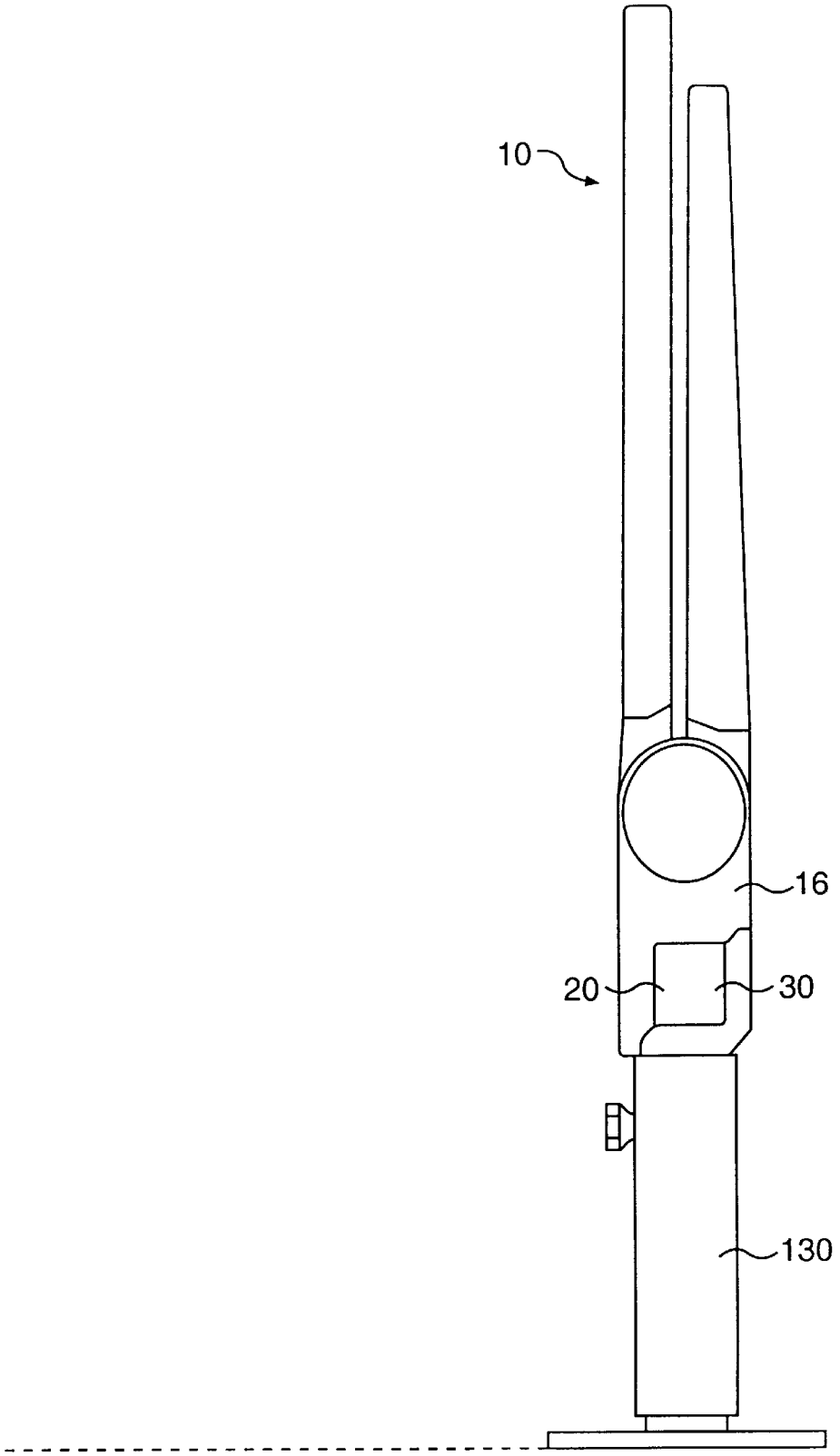
FIG. 7 is a side view of a single seat assembly with a sliding support member in its stowed position.

As embodied herein and referring to FIG. 5, the seat assembly may include a tandem seat (5) and a single seat (10). The tandem seat (5) and the single seat (10) may be used in combination with one another or each in combination with standard stadium seating. Referring now to FIGS. 5 and 6, the single seat (10) includes a back portion (12) and a seat portion (14). Like conventional stadium seating, the seat portion (14) is hingedly connected to the back portion (12). When folding the seat (10), the back portion (12) retains its perpendicular orientation with respect to the ground, whereas the seat portion (14) folds upwardly, lying in a substantially parallel plane with the back portion (12) (as illustrated in FIG. 7). A pair of connecting bars (16) connect the seat (14) and back (12) portions with a sliding support member (20). The single seat (10) is slidably mounted to a single support post (130) by attaching the sliding support member (20) to a central pivot (30). The sliding support member (20) may be mounted to the central pivot (30) by any conventional means, provided that the sliding support member (20) can freely move left and right with respect to the single support post (130) and can swivel about the central pivot point (30). The central pivot (30) may be located at the top of the support post (130) or, alternatively, may be attached at the bottom of the support post (130) and have a bar (not shown) running through the support post (130) to the sliding support member (20).

Figure 8:
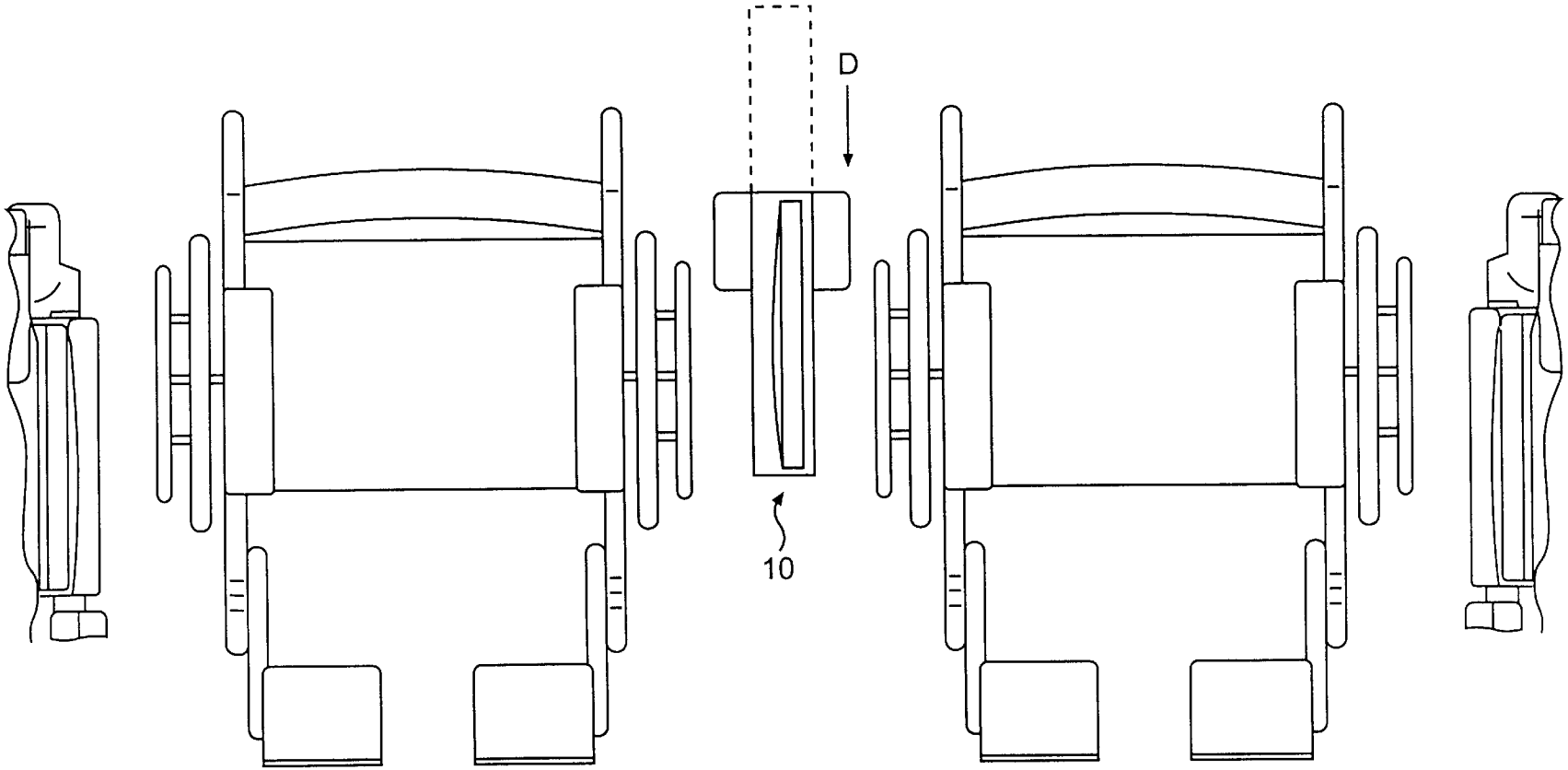
FIG. 8 is a top view of a single seat assembly in the stowed position used in combination with a dual seat assembly.
Figure 9:
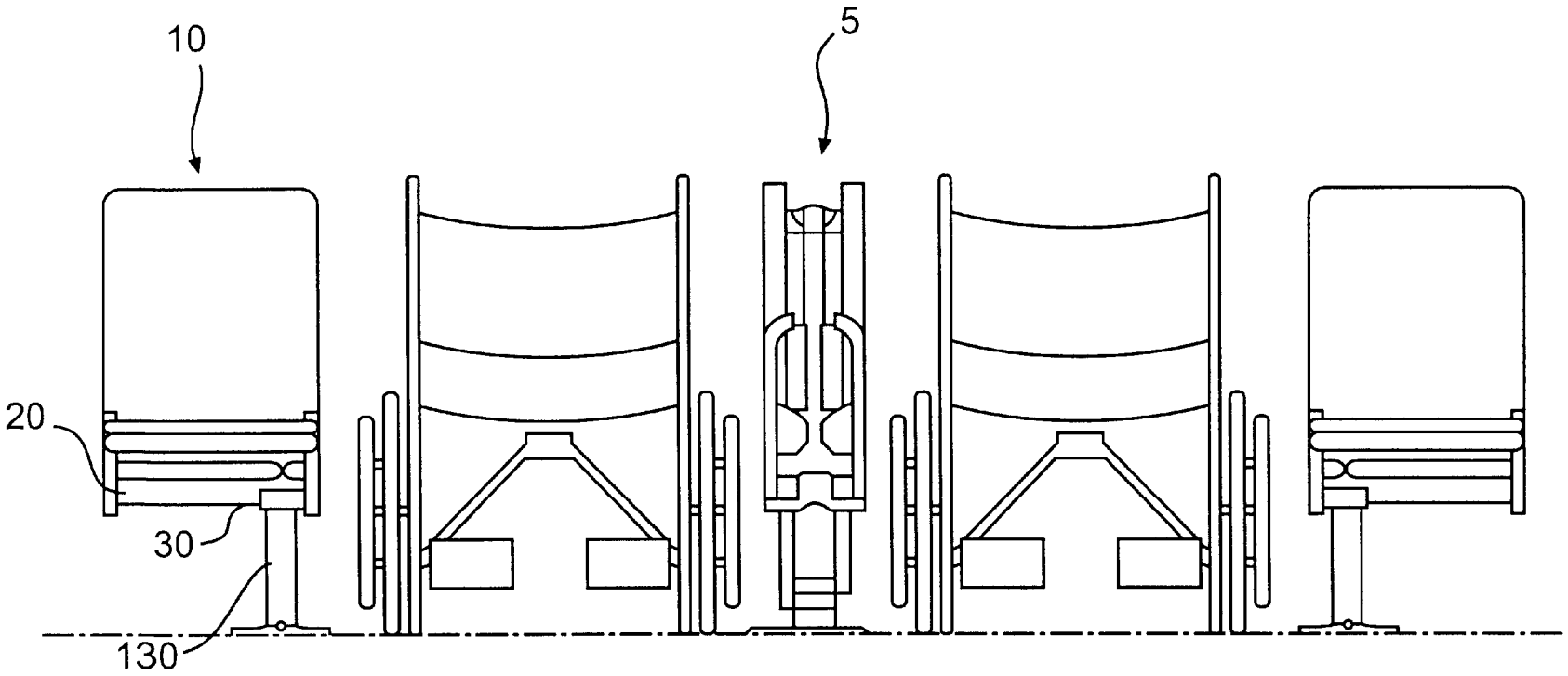
FIG. 9 is a front view of a single seat assembly with a sliding support member used in conjunction with an adjacent wheelchair.
Figure 10:
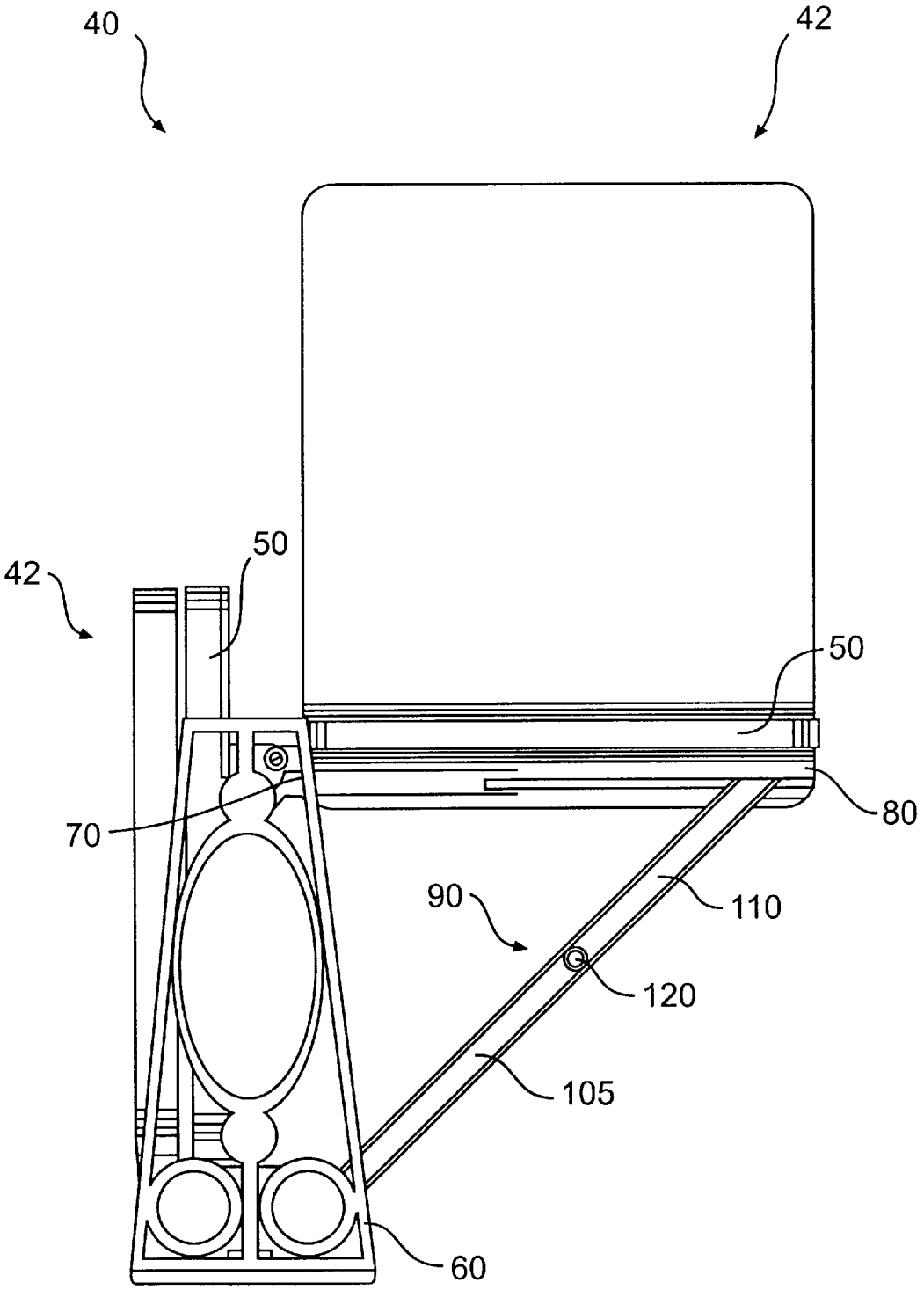
FIG. 10 is a front view of a dual seat assembly with one seat in its stowed position.
Figure 11:
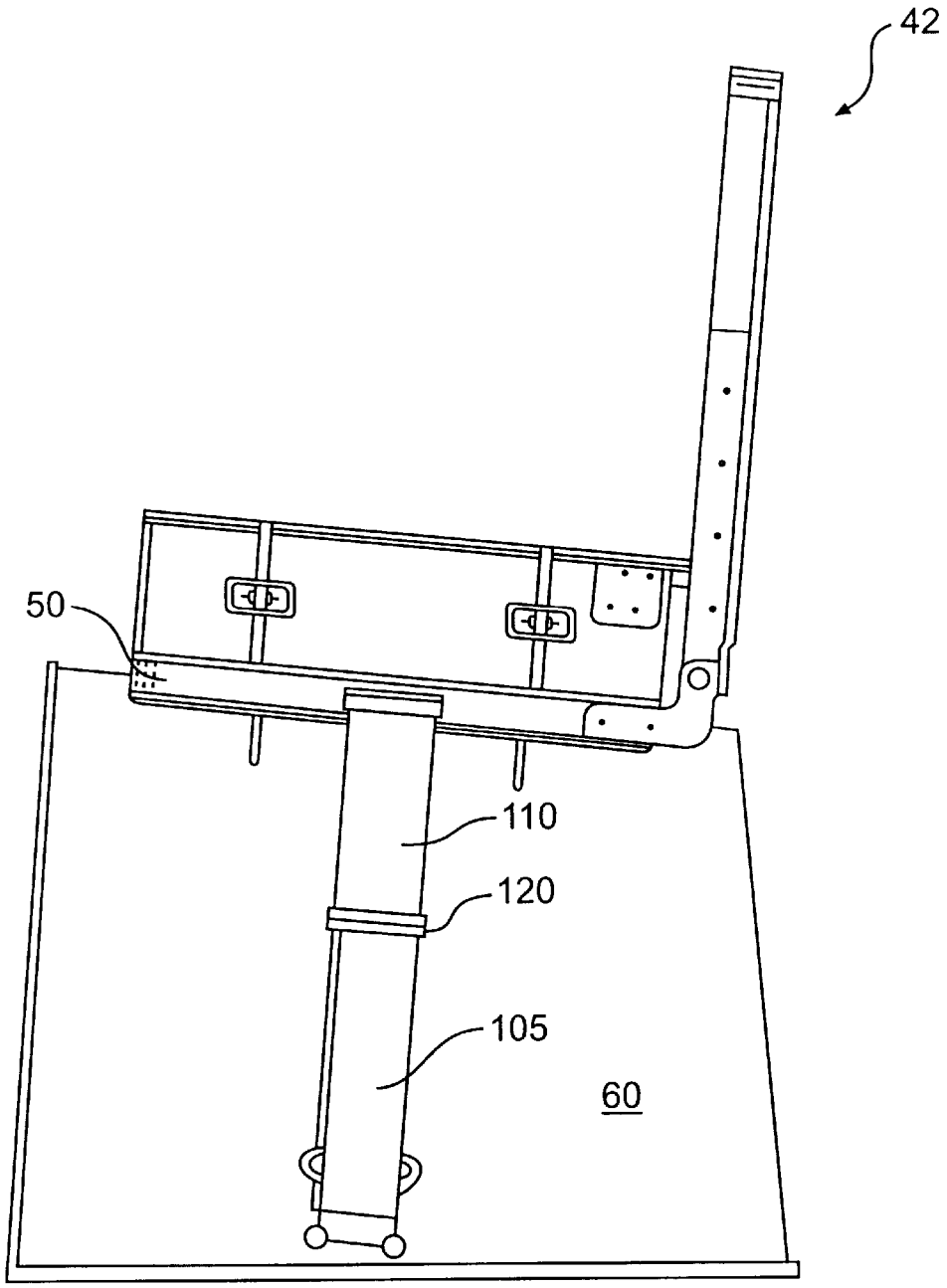
FIG. 11 is a side view of a dual seat assembly.
Figure 12:
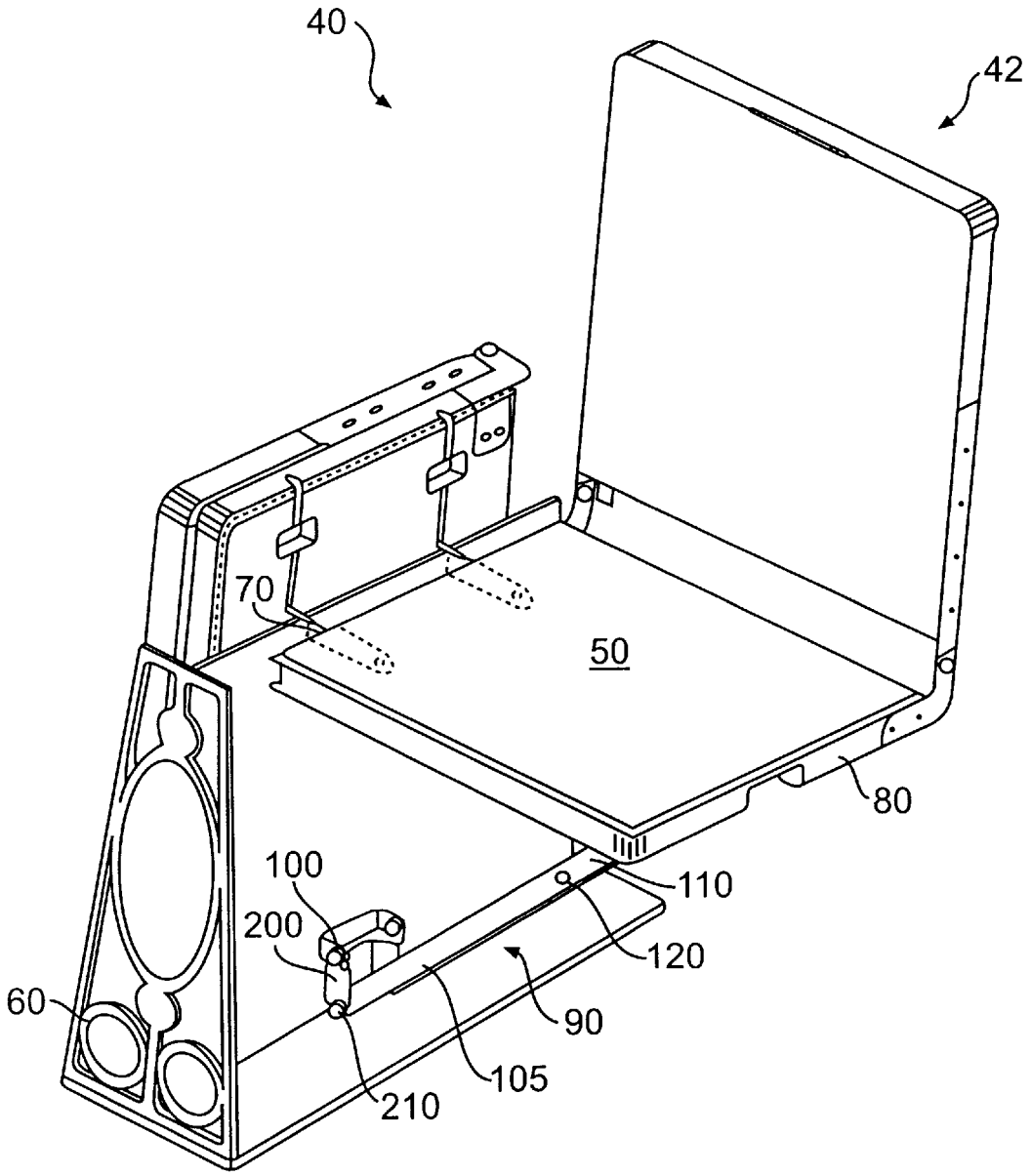
FIG. 12 is a perspective view of a dual seat assembly with one seat in its stowed position.

By mounting the seat in this fashion, the single seat (10), once it is folded and pivoted away, may be further displaced away from the aisle behind the space where the individuals in wheelchairs are residing, as illustrated by Arrow D in FIG. 8. Additionally, utilization of the sliding support member (20) in conjunction with the central pivot point (30) on the single support post (130) creates significant flexibility in seating design, maximizing the number of seats for both individuals in wheelchairs and those using the conventional stadium seating. As illustrated in FIG. 9, the single seat configuration (10) may be slidably positioned to either the left or the right of the central pivot point (30). This configuration allows for a wheelchair to be placed either to the left or to the right of the occupant residing in the single seat (10). For example, referring to FIG. 9, space for a wheelchair may be provided by sliding the single seat configuration (10) to the left and stowing away one of the seats of the tandem seat configuration (5). The single seat configuration (10) is positioned with respect to the tandem seating assembly (5) in such a manner as to allow for the requisite thirty-three inches of space when the single seat configuration (10) is slidably moved either to the left or to the right and one or both of the tandem seats (5) are stowed away.

Figure 13:
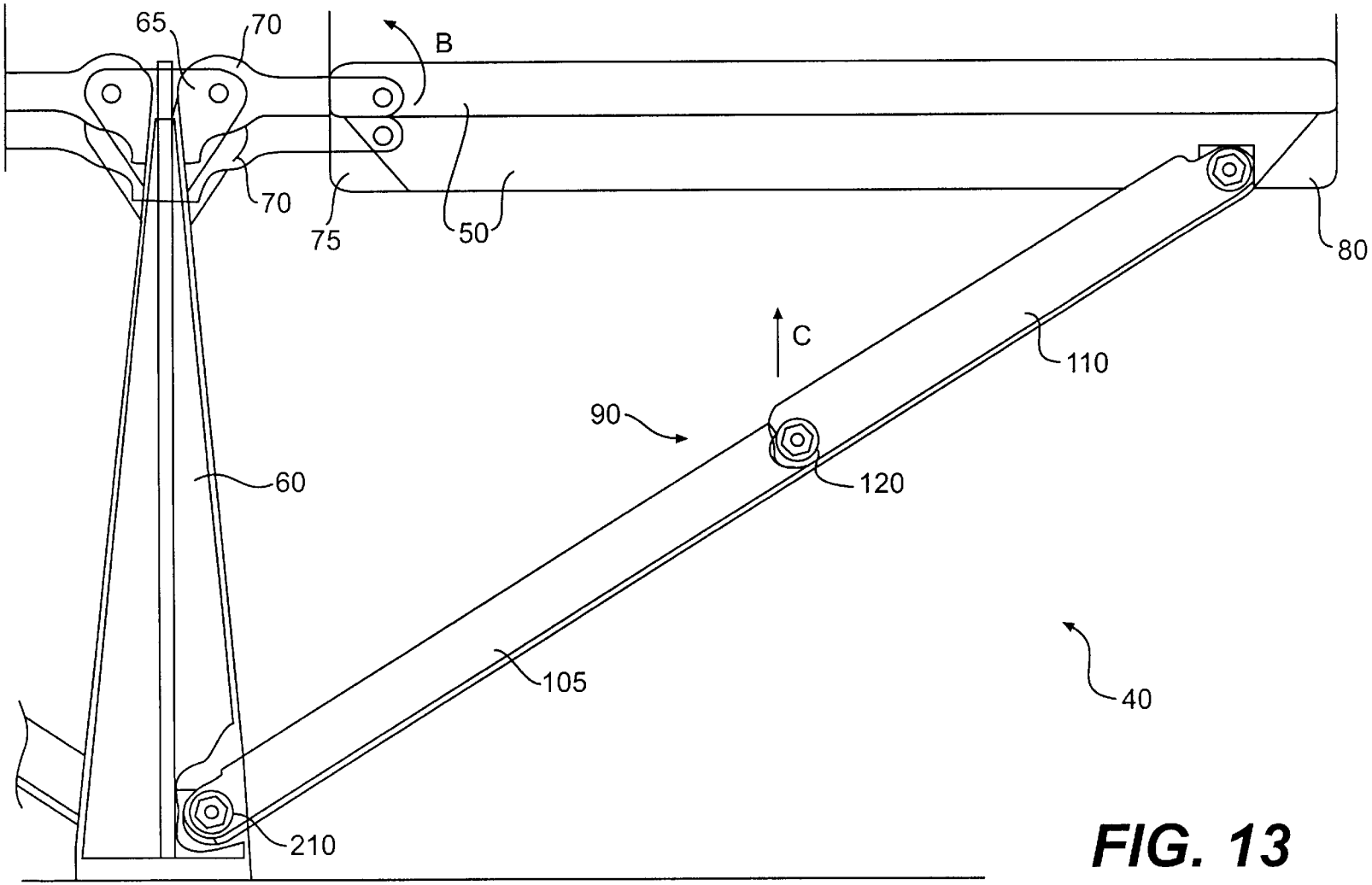
FIG. 13 is a front view of the hinged connections for a dual seat assembly.
Figure 14:
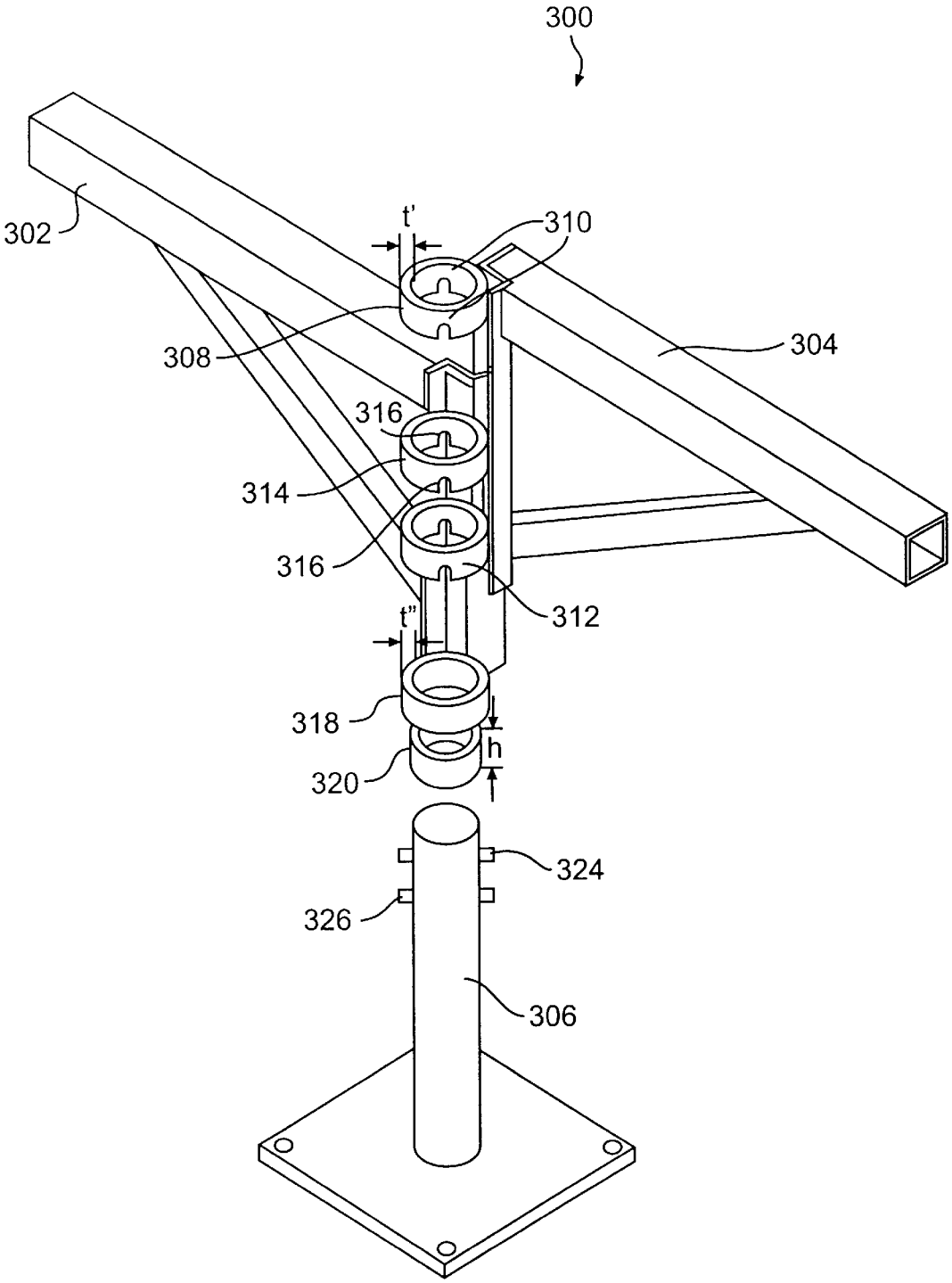
FIG. 14 is a perspective exploded view of two seat frames rotatably and slidably connected to a support pole.

Referring now to FIGS. 10 through 13, another embodiment of the invention will now be described. The tandem seating (40) incorporates a pair of folding seats (42) which fold downward. As best illustrated in FIG. 13, the seat portion (50) is attached to a central frame (60) by an L-shaped member (70) and by brace (90). The L-shaped member (70) is pivotally attached to the central frame (60) at bracket (65) and to the seat portion (50).

To place one of the folding seats (42) of the tandem seating (40) in a compact configuration, the pivot point connecting the L-shaped member (70) and the seat portion (50) is moved upward (illustrated by Arrow B in FIG. 13). Consequently, the left edge (75) of the seat portion (50) moves upward, while the right edge (80) moves toward the ground. The distance between the pivot point on the central frame (60) and the pivot point on the seat portion (50), defining the horizontal length of the L-shaped member (70), is such that when the pivot point on the seat portion (50) is raised upward, the seat portion (50) is allowed to pivot downward without its opposite edge (80) contacting the ground. To accommodate this type of downward folding configuration, a brace (90) is used. As shown, for example, in FIG. 12, one end of the brace (90) is affixed to one end of a compensation link (200) at pivot point (210). The other end of the compensation link (200) is hingedly connected to the lower aspects of the central post (60) at pivot (100). The other end of the brace (90) is affixed to the underside of the seat portion (50), opposite the edge where the pivot point between the seat portion (50) and the L-shaped member (70) resides. The brace (90) is comprised of first and second elongated components (105, 110), pivotally connected to one another at a brace pivot point (120). The first and second elongated components (105, 110) are of suitable lengths to allow the seat portion (50) to nest against the central frame (60) in an approximately vertical position.

When the seat portion (50) is occupied, the brace (90) extends diagonally between the central frame (60) and the seat portion (50), with both first and second elongated components (105, 110) lying in a generally parallel plane. When folding the seat, the pivot point connecting the first and second elongated components (105, 110) of the brace (90) is moved upward (as illustrated by Arrow C in FIG. 13), causing the first and second elongated components (105, 110) to rotate, converging towards one another. As this rotation occurs, the first elongated component (105) rotates about pivot (210). The compensation link (200) in turn rotates upward about pivot (100). The compensation link (200) is sized to compensate for geometric length variations in the brace (90) associated with folding the seat downward to its stowed position. The first elongated component (105) is constructed such that it rests within the second elongated component (110) when the seat is completely folded, allowing for a compact configuration (see FIG. 10). The second elongated component (110) is substantially u-shaped and sized to receive the first elongated component (105).

Figure 15:
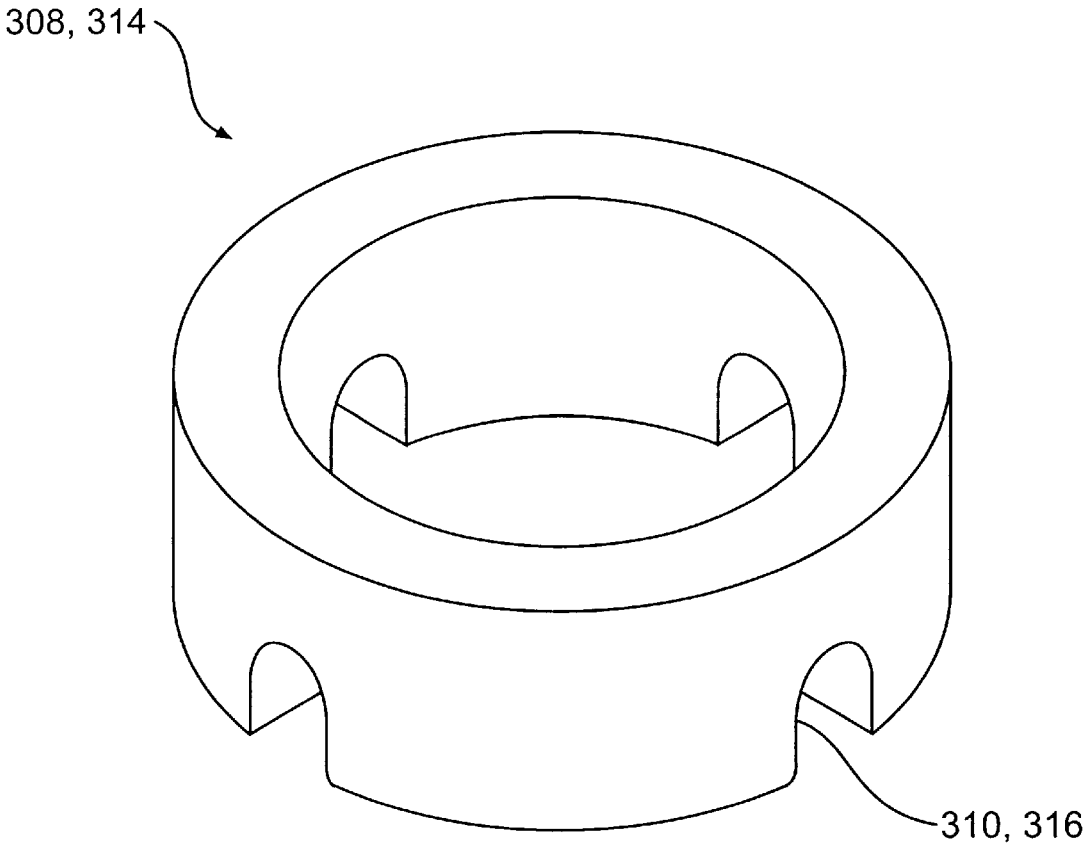
FIG. 15 is a perspective view of an index ring.

Referring now to FIGS. 14 through 17, another embodiment of the tandem seat will be described. As broadly shown in FIG. 14, the tandem seat (300) may have a left frame (302) and a right frame (304) rotatably and slidably attached to a support pole (306). The support pole (306) may be circular and includes an upper index pin (324) and a lower index pin (326). The right frame (304) may have an upper right index ring (308) and a lower right index ring (312), both sized to be concentric about the support pole (306), and both having a width t'. As best shown in FIG. 15, the lower surface of the upper right index ring (308) has four upper index pin receiving portions (310) sized to receive the upper index pin (324) on the support pole (306).

The left frame (302) includes an upper left index ring (314) and a lower left index ring (318). The upper left index ring (314) is sized to be concentric about the support pole (306) and may have four lower index pin receiving portions (316) sized to receive the lower index pin (326) on the support pole (306) (shown in FIG. 15). The upper left index ring (314) has a width t'. The lower left index ring (318) has a width t" and is sized to be concentric about a spacer ring (320). The upper and lower left index rings (314, 318) have the same outside diameter as the upper and lower right index rings (308, 312). The upper and lower right index rings (308, 312) and the upper left index ring (314) have the same inside diameter. The inside diameter of the lower left index ring (318) is slightly larger than the inside diameters of the other rings (308, 312, 314), allowing the lower left index ring (318) to be concentric about the spacer ring (320). The spacer ring (320) has an inside diameter slightly larger than the outside diameter of the support pole (306) and an outside diameter slightly smaller than the inside diameter of the lower left index ring (318), but larger than the inside diameter of the lower right index ring (312).

Figure 16:
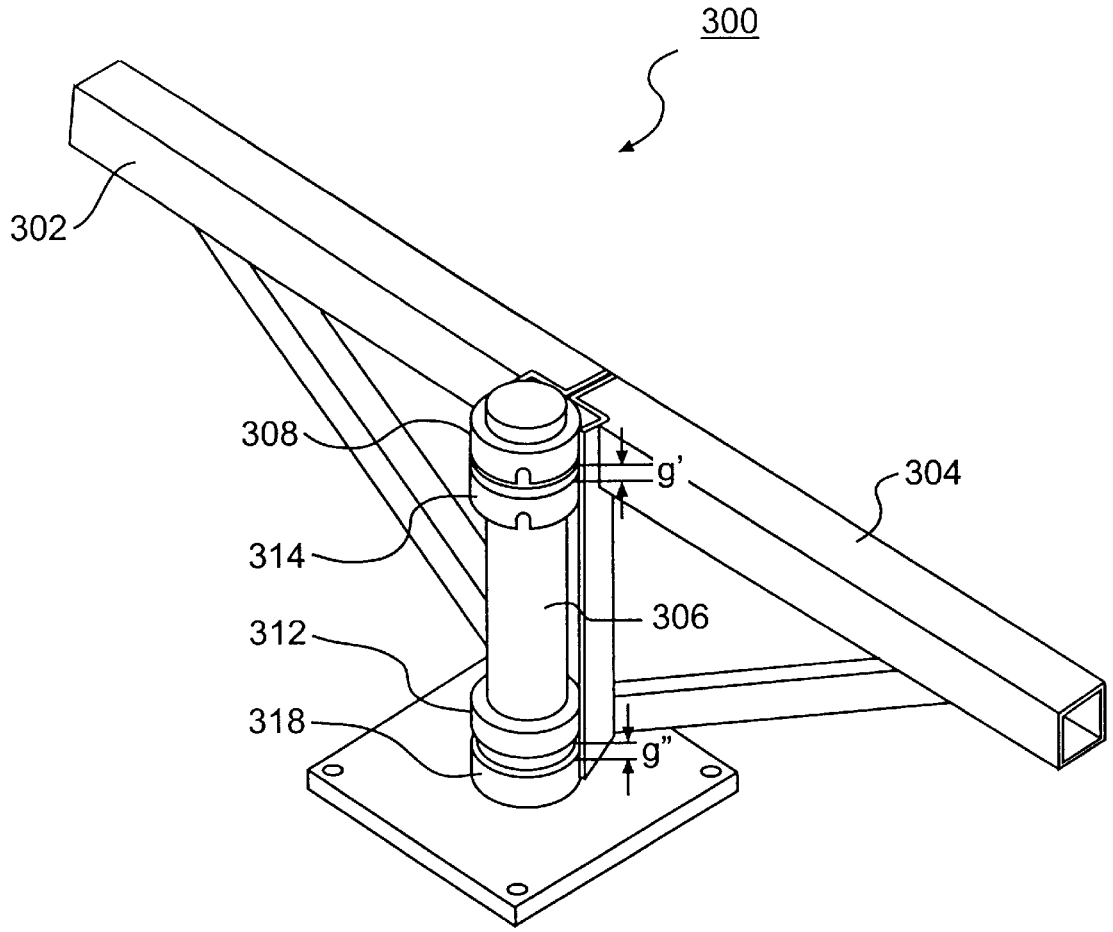
FIG. 16 is a perspective view of two seat frames rotatably and slidably connected to a support pole.
Figure 17:
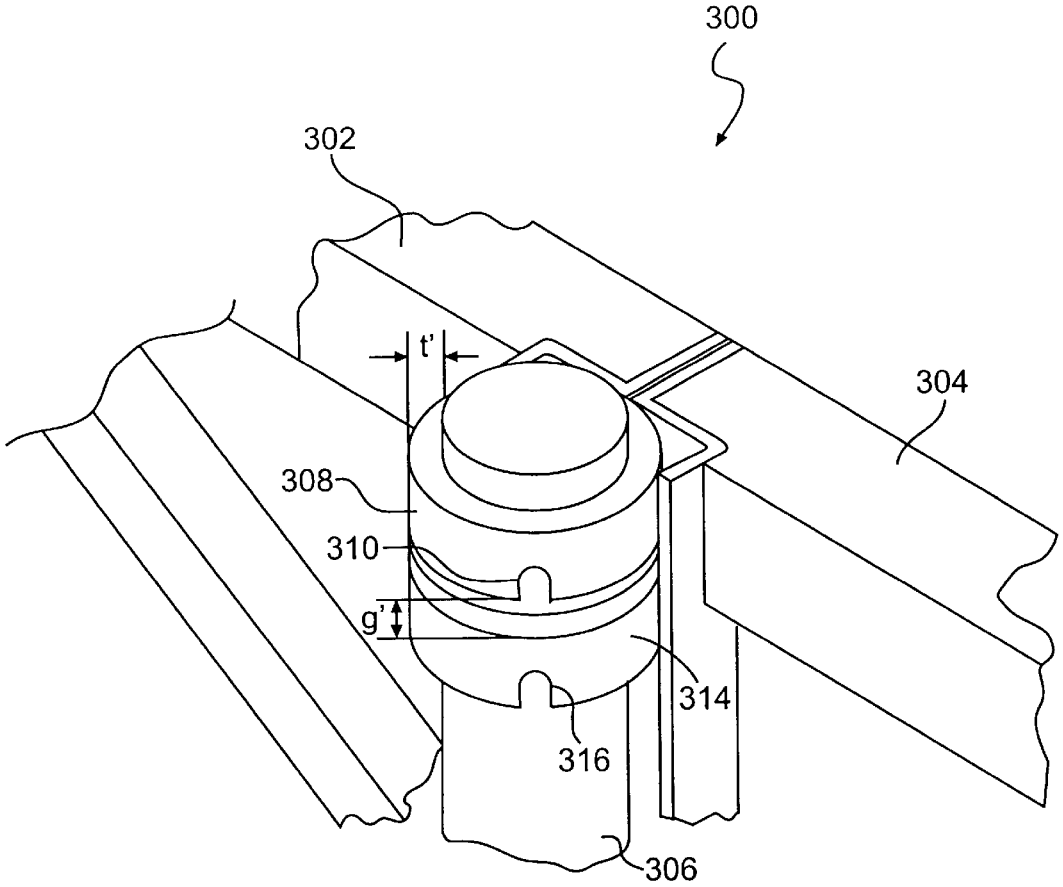
FIG. 17 is a close-up perspective view of two seat frames rotatably and slidably connected to a support pole.

When both seats of the tandem seat (300) are occupied (as shown in FIG. 16), two opposing upper index pin receiving portions (310) on the lower surface of the upper right index ring (308) engage the upper index pin (324) on the support pole (306). The lower right index ring (312), having an inside diameter slightly smaller than the outside diameter of the spacer ring (320), rests on the top surface of the spacer ring (320). Likewise, the two opposing lower index pin receiving portions (316) on the lower surface of the upper left index ring (314) engage the lower index pin (326) on the support pole (306). The upper index pin (324) and the lower index pin (326) are positioned on the support pole (306) so that a gap (g') is created when the upper right index ring (308) and the upper left index ring (314) engage the upper and lower index pins (324, 326), respectively. The spacer ring (320) has a height (h) such that a gap (g") is created between the lower surface of the lower right index ring (312) and the upper surface of the lower left index ring (318).

Stowing one or both of the seats may be accomplished as follows. To stow the seat connected to the right frame (304), the right frame (304) is lifted upward, disengaging two of the opposing upper index pin receiving portions (310) from the upper index pin (324). The right frame (304) is then rotated until the two other opposing upper index pin receiving portions (310) are directly above the upper index pin (324). The right frame (304) is then guided downward so that the two other opposing upper index pin receiving portions (310) engage the upper index pin (324), locking the right frame (304) in its stowed position. Similarly, the left frame (302) is lifted upwardly, disengaging two of the opposing lower index pin receiving portions (316) from the lower index pin (326). The gaps g' and g" allow the left frame (302) to be raised upwardly without requiring the right frame (304) to be raised upwardly or rotated. The left frame (302) is then rotated until the two other opposing lower index pin receiving portions (316) are directly above the lower index pin (326). The left frame (302) is then guided downward so that the two other opposing lower index pin receiving portions (316) engage the lower index pin (326), locking the left frame (302) in its stowed position. This configuration allows the left frame (302) or the right frame (304) to be stowed or opened independently of one another.

FIGS. 18–36 show various embodiments where the tandem seat may be stowed and unstowed without requiring any upward or downward movement of the indexing rings (also referred to as flanges). These embodiments are a variation from the FIGS. 14–17 tandem seats which require an upward or downward movement of the indexing rings in order to adjust the position of the seats between the stowed and unstowed positions. Like or similar parts will be identified throughout FIGS. 18–36 by the same reference characters as FIGS. 14–17.

The embodiments of FIGS. 18–36 all generally show a seating arrangement comprising two seats each having a frame having upper and lower indexing rings; and a circular support pole. The upper and lower indexing rings of one frame are configured to rest above the upper and lower indexing rings of the other frame. The indexing rings are concentric and rotatable about the support pole. The indexing rings are provided with an indexing and restraining means for independently placing one of the seats in one of an occupied and stowed position independently of the other seat, without requiring any upward or downward movement of the indexing rings. The detent arrangement has a pair of flexible detent surfaces and an index pin for each frame. The pair of flexible detent surfaces engages the index pin attached to the support pole. Each frame has an annular slot. The annular slot has a first end representing the stowed position of the seat and an opposite end representing the in-use position of the seat. In order to place the seat in either the stowed or in-use position one of the flexible detent surfaces must be deflected out of the path of the index pin, the flexible detent surface thereby maintaining the index pin in its respective position at the respective end of the annular slot.

Figure 18:
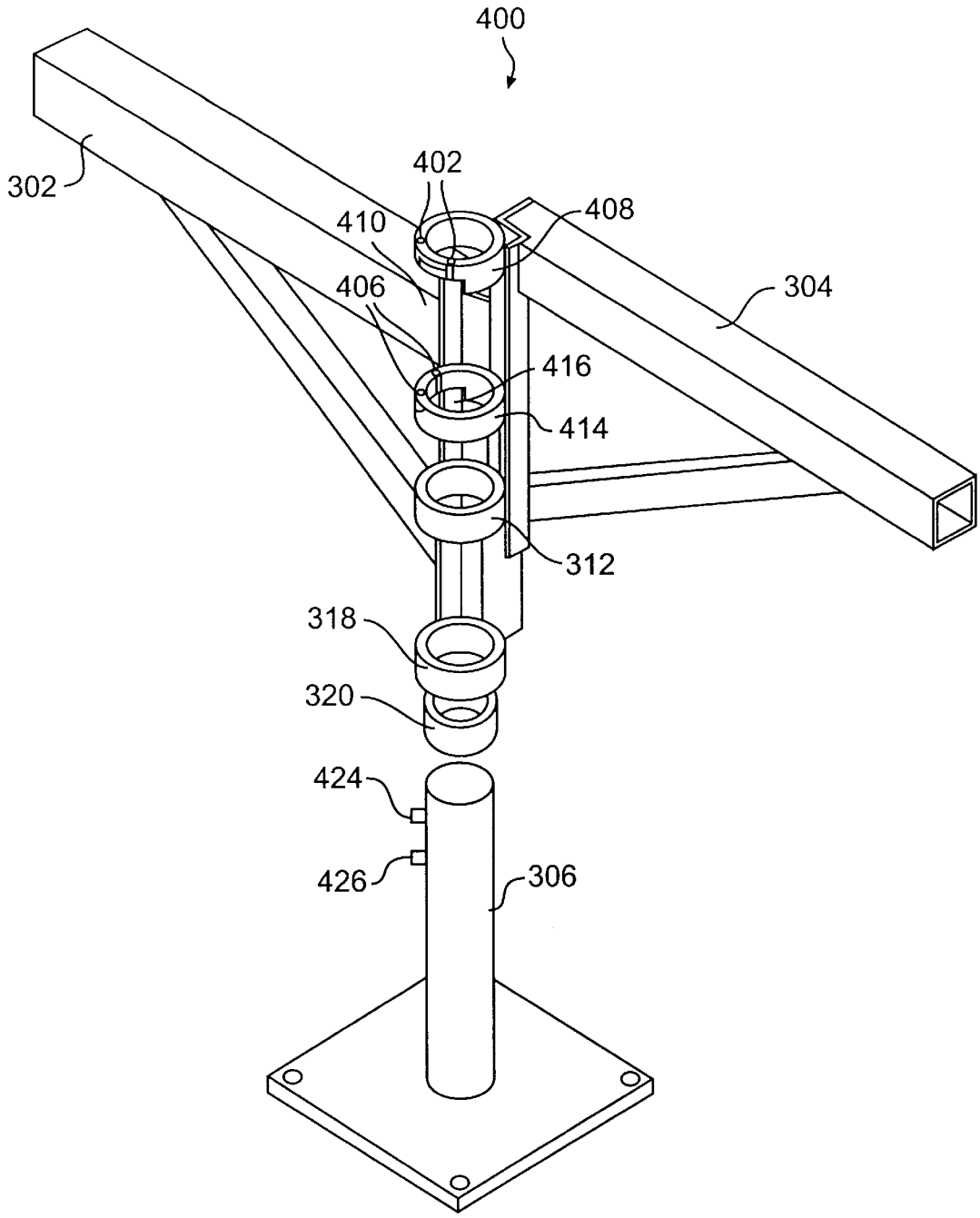
FIG. 18 is a perspective exploded view of two seat frames rotatably connected to a support pole according to another embodiment of the invention.
Figure 19:
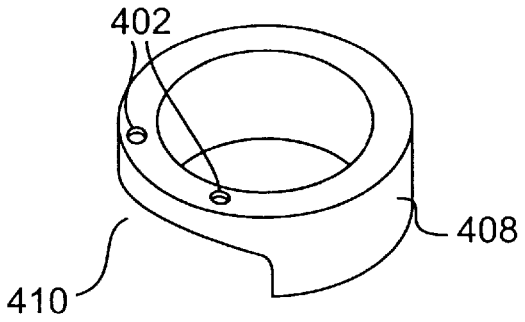
FIG. 19 is a perspective view of an upper index ring of FIG. 18.
Figure 20:
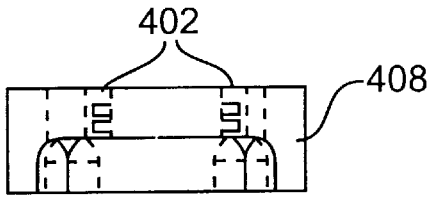
FIG. 20 is a front view of the upper index ring of FIG. 18.
Figure 21:
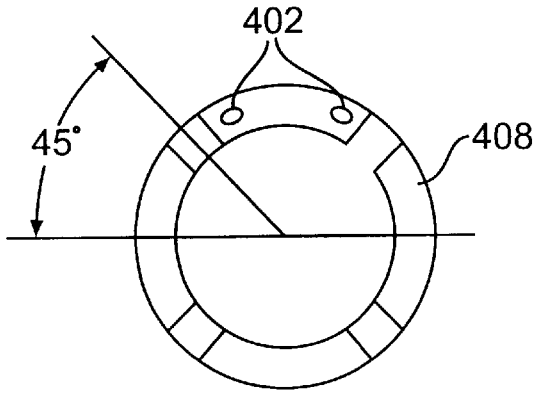
FIG. 21 is a bottom view of the upper index ring of FIG. 18.
Figure 22:
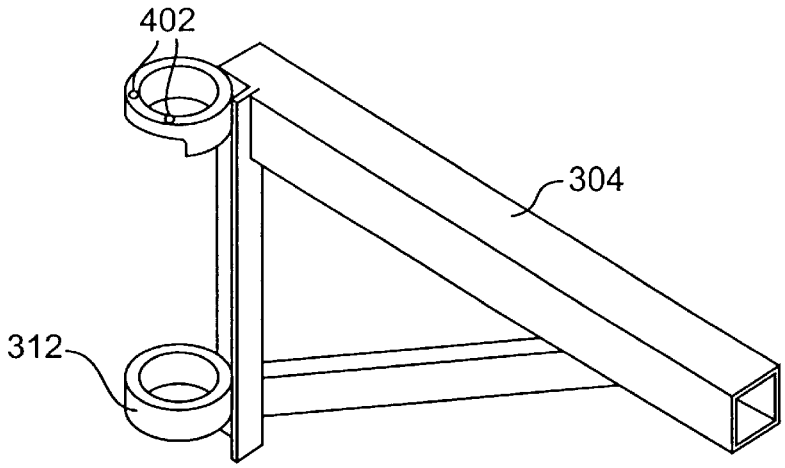
FIG. 22 is a perspective view of the right frame of FIG. 18.
Figure 23:
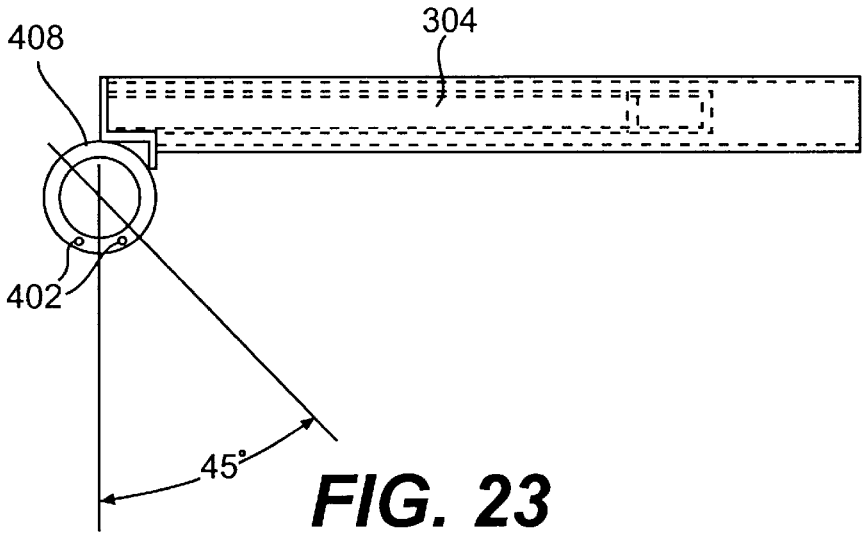
FIG. 23 is a top view of the right frame of FIG. 18.
Figure 24:
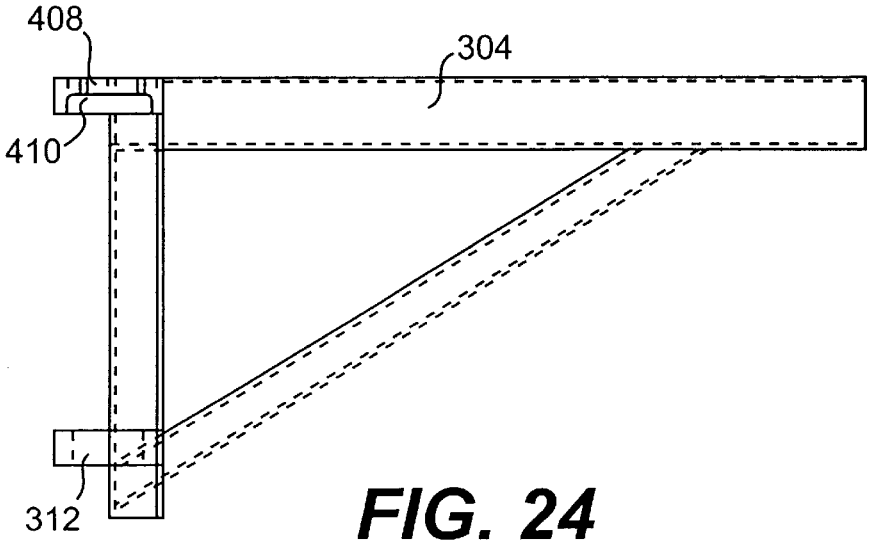
FIG. 24 is a front view of the right frame of FIG. 18.
Figure 25:
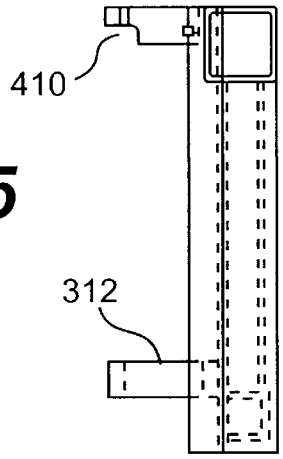
FIG. 25 is a right view of the right frame of FIG. 18.
Figure 26:
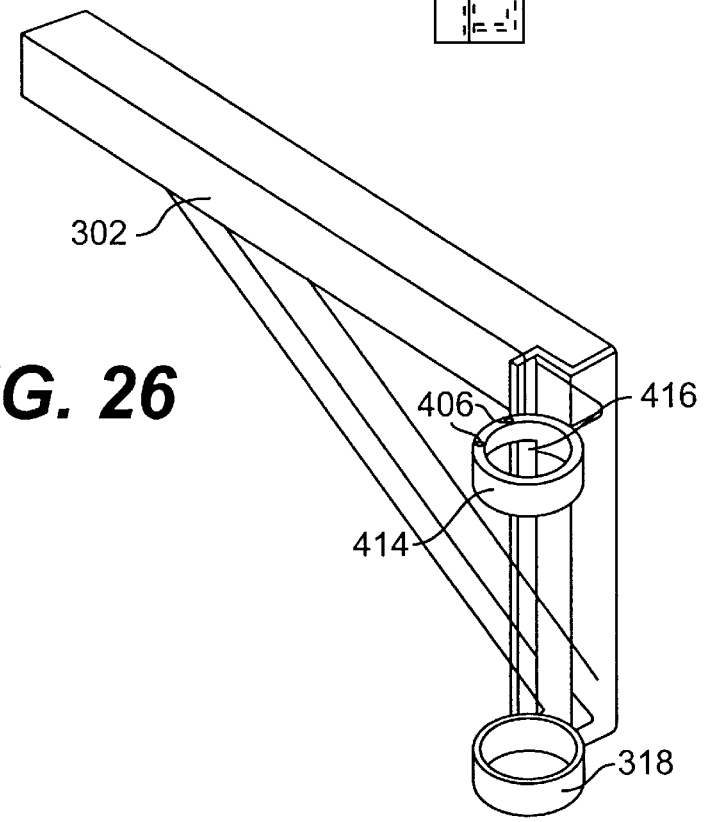
FIG. 26 is a perspective view of the left frame of FIG. 18.
Figure 27:
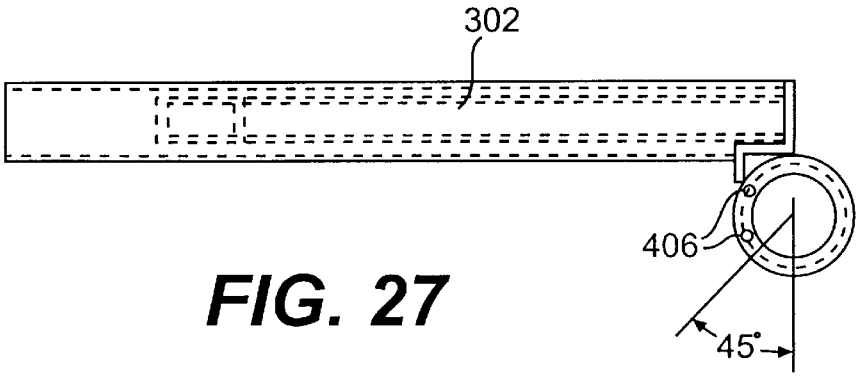
FIG. 27 is a top view of the left frame of FIG. 18.
Figure 28:
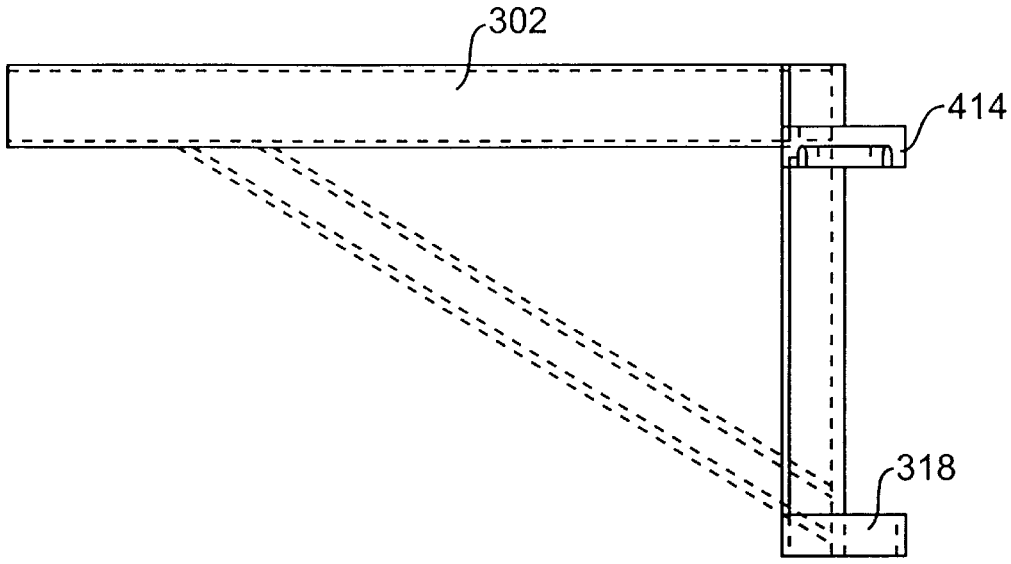
FIG. 28 is a front view of the left frame of FIG. 18.
Figure 29:
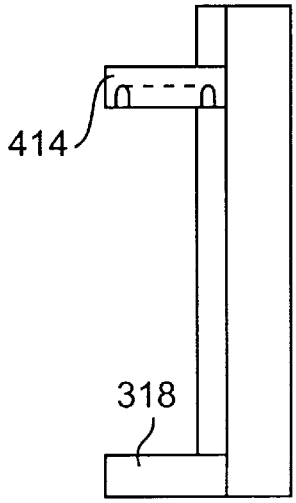
FIG. 29 is a right view of the left frame of FIG. 18.

Reference will now be make in detail to the embodiment of FIGS. 18–29. As broadly shown in FIG. 18, the tandem seat (400) may have a left frame (302) and a right frame (304) rotatably and slidably attached to the support pole (306). The support pole (306) includes an upper index pin (424) and a lower index pin (426). In this embodiment, the index pins (424, 426) extend radially out from the support pole on only one side of the support pole. The right frame (304) may have an upper right index ring (408) and a lower right index ring (312), both sized to be concentric about the support pole (306). As best shown in FIG. 19, the lower surface of the upper right index ring (408) has an annular groove (410) sized to receive the upper index pin (424) on the support pole (306). The annular groove (410) of the upper right index ring (408) is located on the portion of the index ring opposite the right frame (304) as best shown in FIG. 22. The annular groove (410) extends around the bottom of the index ring for 90 degrees. The left frame (302) includes an upper left index ring (414) and a lower left index ring (318). The upper left index ring (414) is sized to be concentric about the support pole (306). The lower surface of the upper left index ring (414) has an annular groove (416) sized to receive the lower index pin (426). The annular groove (416) of the upper left index ring (414) is located on the portion of the index ring which is in the direction which the left frame (302) extends as best shown in FIG. 26. The annular groove (416) extends around the bottom of the index ring for 90°. The annular groove (410) of the upper right index ring (408) is offset 90° from the annular groove (416) of the upper left index ring (318) when the seats are in the in-use position as shown in FIG. 18. The lower left index ring (318) and support ring (320) are identical to that described in FIGS. 14–17.

The upper right index ring (408) is provided with a pair of flexible detent surfaces which are ball detent screws (402). The pair of ball detent screws (402) extend axially through the upper index ring (408) to project into the annular groove (410). This pair of ball detent screws (402) contact the upper index pin (424) as the upper right index ring (408) is rotated about the support pole. The upper left index ring (414) is also provided with a pair of ball detent screws (406) which extend axially through the upper left index ring (414) to project into the annular groove (416). This pair of ball detent screws (406) contact the lower index pin (426) as the upper left index ring (414) is rotated about the support pole. These ball detent screws project a sufficient distance into the annular groove so that they can contact the respective index pin as the index pin traverses the annular groove. The ball detent screws are deflected out of the path of the index pin when contacted by the index pin if a sufficient external force is imparted on the seat. The ball detent screws provide a sufficient force to maintain the index pins in the end positions of the annular groove when no external force is applied to the seat. However, the bias force is low enough that it can be easily overcome by a person who wishes to rotate the seat its appropriate position.

When both seats of the tandem seat (400) are occupied (as shown in FIG. 18), the seat frames (302, 304) are located at 180° angles to each other. The operation of the right seat to move from the in-use to the stowed position will be demonstrated as follows. At the in-use position shown in FIG. 18, the upper index pin (424) is located at one end of the annular groove (410) of the upper right index ring (408), the one end corresponding to the in-use position of the seat. At the end position, the index pin rests against the end stop surface of the annular groove. At this position, the bias from the respective ball detent screw (402) on the index pin (424) holds the upper right indexing ring (408) and frame (304) in the in-use position. The frame (304) will remain stationary until it is desired to place the seat in the stowed position.

The frame can be easily moved to the stowed position by imparting a rotary force on the frame about the support pole. The rotary force must be sufficient to overcome the bias force on the index pin (424) from the ball detent screw (402) corresponding to the in-use end of the annular groove. When the seat is rotated, the ball detent screw (402) will be deflected out of the path of the annular groove (410) by the upper index pin (424). The upper right index ring will then rotate until the other ball detent screw (402) of the pair of detent screws is contacted by the upper index pin and pushed out of the path of the upper index pin. When the upper index pin passes beyond the other ball detent screw corresponding to the stowed end of the annular groove, the seat is in the stowed position. The index pin will now rest against the other end stop surface of the annular groove. The seat will remain in the stowed position due to the bias force on the upper index pin (424) from the ball detent screw (402) at the stowed end of the annular groove. As can be seen from the operation described above, the seat can be moved between the stowed and in-positions, and vice versa, without any upward or downward movement of the frames.

The left seat can be moved from the in-use position shown in FIG. 18 in the identical manner as described above for the right seat. The structure and operation of the left seat is essentially the same as the right seat and will not be described in detail. With the left seat, the detent ball screws (406) of the upper left index ring (414) engage with the lower index pin (426) which traverses the annular groove (416). The left frame (302) may be rotated so that the upper left index ring (414) will rotate relative to the support pole to position the seat in the stowed position in a similar manner as for the right seat.

Figure 30:
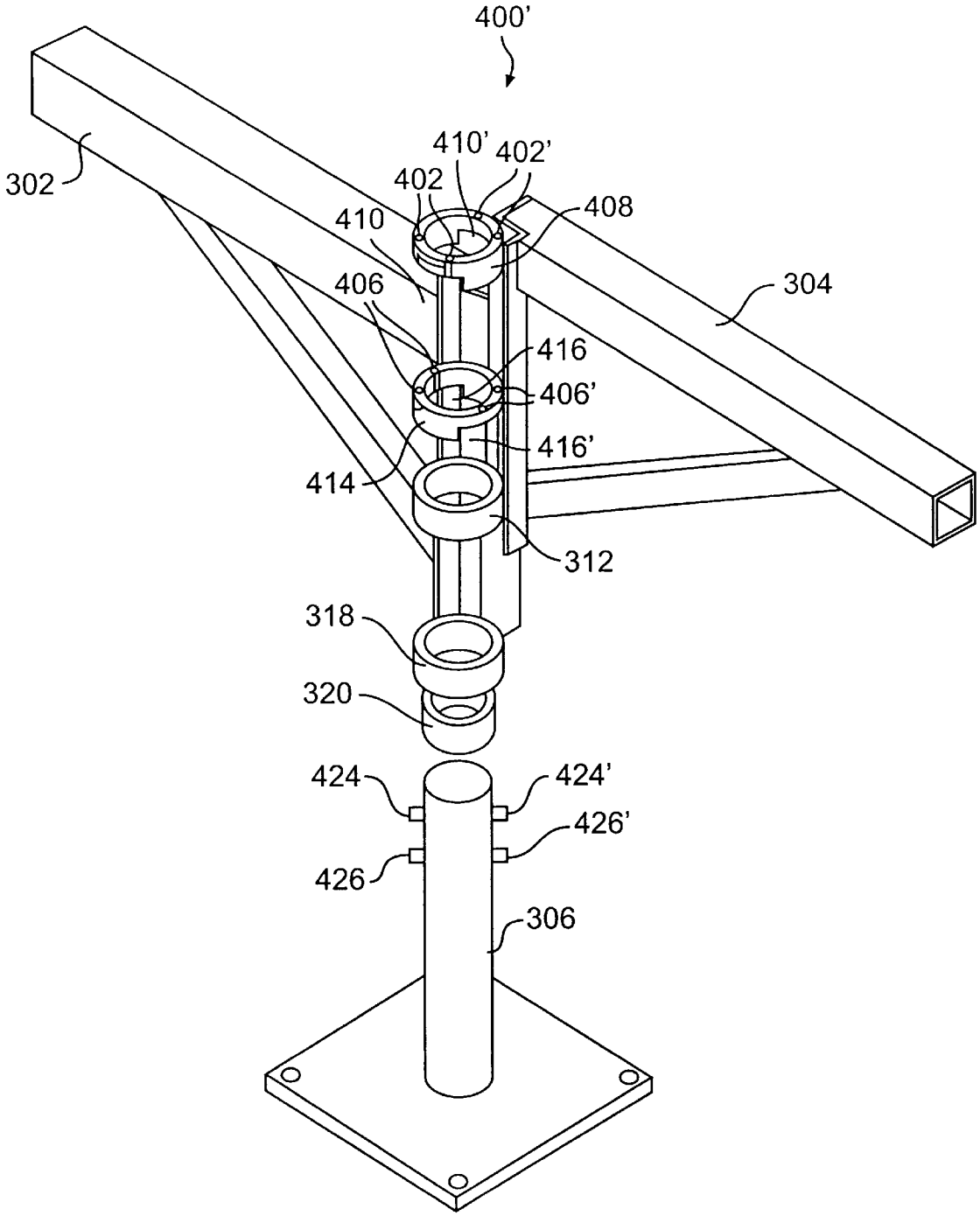
FIG. 30 is a perspective exploded view of two seat frames rotatably connected to a support pole according to another embodiment.

FIG. 30 shows an embodiment wherein two sets of annular grooves and ball detent screw pairs are provided. This configuration may be desired in order to have more balanced forces on the seating arrangement. The tandem seat (400') has substantially the same structure as shown in FIGS. 18–29, but further includes: second annular groove (410') and second pair of ball detent screws (402') in the upper right index ring (408); second annular groove (416') and second pair of ball detent screws (406') in the upper left index ring (414); and the second portion of the upper index pin (424') and the second portion of the lower index pin (426') extending on the opposite sides of the support pole as the first portion (424) of the upper index pin (424,424') and first portion (426) of the lower index pin (426, 426'), respectively. The upper index pin portions (424 and 424') can be considered to be a single index pin which extends radially from the support pole on both sides of the support pole. The lower index pin portions (426 and 426') can be considered to be a single index pin which extends radially from the support pole on both sides of the support pole.

Figure 31:
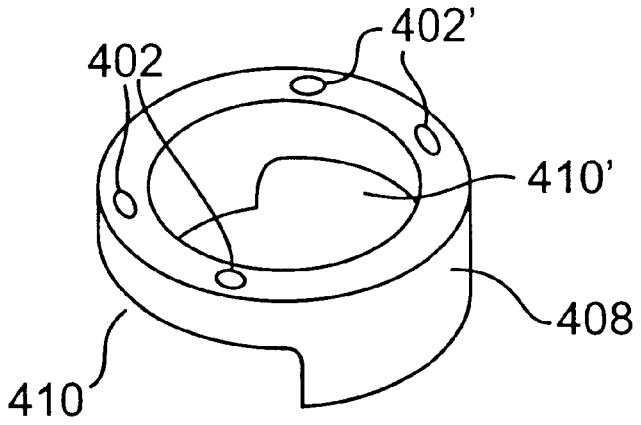
FIG. 31 is a perspective view of an upper index ring of FIG. 30.
Figure 32:
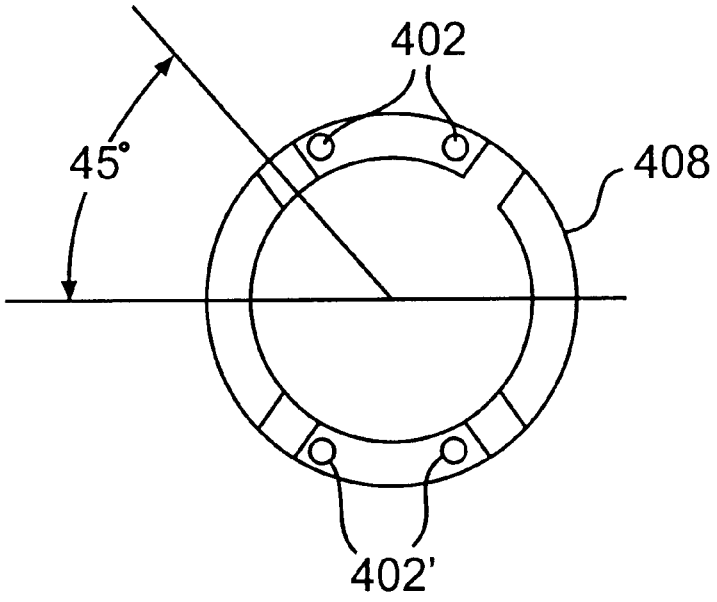
FIG. 32 is a bottom view of an upper index ring of FIG. 30.

As discussed with regard to FIGS. 18–29 embodiment, in the FIG. 30–32 embodiment the first portion (424) of the upper index pin engages with the annular groove (410) and the first pair of ball detent screws (402) of the upper right index ring (408). Similarly, the first portion (426) of the lower index pin engages with the annular groove (416) and the first pair of ball detent screws (406) of the upper left index ring (414). The second portion (424') of the upper index pin engages with the second annular groove (410') and the second pair of ball detent screws (402') of the upper right index ring (408). The second portion (426') of the lower index pin engages with the second annular groove (416') and the second pair of ball detent screws (406') of the upper left index ring (414). As best shown in FIG. 32, the second pair of ball detent screws (402') are located on the diametrically opposite portion of the index ring compared to the first pair of ball detent screws (402). The second annular groove (410') is also located on the diametrically opposite portion of the index ring compared to the first annular groove (410).

The operation of the right frame in order to move the right seat from the in-use position shown in FIG. 30 to the stowed position will be described below. The first pair of ball detent screws (402) engage the first portion (424) of the upper index pin in the first annular groove (410) in an identical manner to that shown and discussed in the FIG. 18–19 embodiment. However, the second pair of ball detent screws (402') will be engaging the second portion (424') of the upper index pin in the second annular groove (410'). Therefore, when the first portion (424) of the upper index pin is engaging the end of the annular groove (410), the second portion (424') will be engaging the end of the second annular groove (410'). The addition of this additional structure will balance the forces of the seat on the support pole.

The left seat can be moved from the in-use position shown in FIG. 30 in the identical manner as described above for the right seat. The structure and operation of the left seat is essentially the same as the right seat and will not be described in detail. With the left seat, the detent ball screws (406, 406') of the upper left index ring (414) engage with the lower index pin (426, 426') which traverses the annular grooves (416, 416'), respectively. The left frame (302) may be rotated so that the upper left index ring (414) will rotate relative to the support pole to position the seat in the stowed position in a similar manner as for the right seat.

Figure 33:
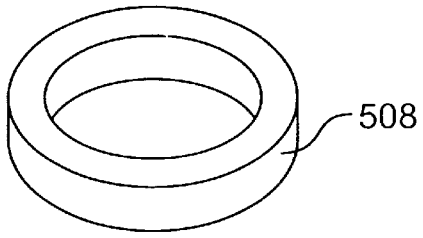
FIG. 33 is perspective view of an upper index ring according to another embodiment.
Figure 34:
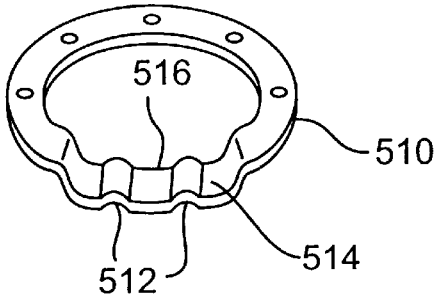
FIG. 34 is a perspective view of a detent spring ring to be used in conjunction with the upper index ring of FIG. 33.
Figure 35:
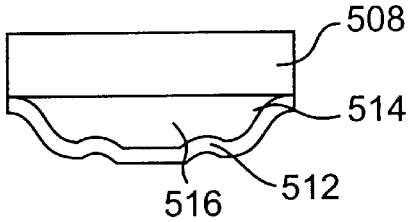
FIG. 35 is a front view of the upper index ring and detent spring ring of FIGS. 33 and 34.

FIGS. 33–35 show another embodiment of providing a pair of flexible detent surfaces to a tandem seat arrangement. This embodiment constitutes the use of a detent spring ring (510) which is attached to the bottom surface of an upper index ring (508). The index ring may have a flat bottom surface as shown in FIG. 33. The detent spring ring can be attached to the bottom of the upper indexing ring by any known means, such as fasteners or adhesives. The annular slot (516) for the respective index pin is provided in the axial space between a portion of the detent spring ring which is spaced from the index ring and the bottom surface of the index ring. The pair of flexible detent surfaces (512) are located on that portion of the detent spring ring which is spaced from the indexing ring. The index pin will be constrained within the annular slot and biased at the ends (514) of the annular slot (516) by the flexible detent surfaces (512) which are raised portions projecting into the annular slot to abut the index pin. This embodiment would use an upper index pin which only projects from one side of the support pole. The lower index pin will also only project from one side of the support pole. This embodiment will function in a manner similar to that described for the embodiment of FIGS. 18–29. A large number of different types of detent spring rings may be envisaged, only one example is shown in FIGS. 33–35.

This embodiment can alternately be modified so that there are two annular slots, and two sets of flexible detent surfaces on the detent spring ring (510). This would encompass providing an additional set of flexible detent surfaces and spaced portion on the opposite side of the detent spring ring. In addition, the upper and lower indexing pin would need to project from both sides of the support pole (see FIG. 30). This would function in a manner similar to that described for FIGS. 30–32.

Figure 36:
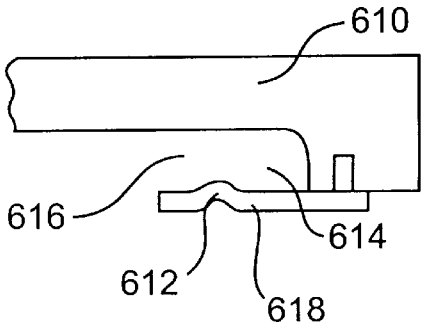
FIG. 36 is a front view of the upper index ring and the detent spring clip according to another embodiment.

FIG. 36 shows another embodiment of the present invention. This embodiment shows the detent arrangement being a pair of detent spring clips (618). These detent spring clips are attached to the bottom portion of the upper index ring (610) at each of the extreme ends of an annular groove (616) formed in the upper index ring. Each detent spring clip (618) has a raised flexible detent surface (612) which will engage the index pin as it traverses the annular groove. The raised flexible detent surface (612) will bias the index pin to maintain the seat in either the in-use or stowed position. This is done by maintaining the index pin in the end position (614) of the annular groove. This embodiment would use an upper index pin which only projects from one side of the support pole. The lower index pin will also only project from one side of the support pole. This embodiment will function in a manner similar to that described for the embodiment of FIGS. 33 through 35. A large number of different types of detent spring clips may be envisaged, only one example is shown in FIG. 36.

This embodiment can alternately be modified so that two annular grooves are provided in each upper index ring. These grooves would be located on opposite portions of the bottom portion of the upper index ring. In addition, the upper index pin would need to project from both sides of the support pole (see FIG. 30). This would function in a manner similar to that described for FIGS. 30–32.

It will be apparent to those skilled in the art that various modifications and variations can be made in the details of the present invention without departing from the spirit or scope of the invention. Thus, it is intended that the present invention cover the modifications and variations of this invention provided they come within the scope of the appended claims and their equivalents.

What is claimed is:

1. A seating arrangement comprising:

two seats each having a frame having upper and lower circular flanges; and a circular support pole;

said upper and lower flanges of one frame being configured to rest above said upper and lower flanges of said other frame, said flanges being concentric and rotatable about said support pole, said flanges provided with a detent arrangement for each frame comprising a pair of flexible detent surfaces and an index pin for each frame, said pair of flexible detent surfaces engaging a single said one said index pins attached to said support pole, said detent arrangement configured for independently placing one of said seats in one of an occupied and stowed position independently of said other seat, without requiring any upward or downward movement of the flanges.

2. The seating arrangement according to claim 1, wherein said detent arrangement for each said frame further comprises an annular slot, said annular slot having a first end representing the stowed position of said seat and an opposite end representing the occupied position of said seat, wherein in order to place said seat in either the stowed or occupied position one of said flexible detent surfaces of said pair of flexible detent surfaces must be deflected out of the path of said index pin, said one of said flexible detent surfaces thereby maintaining said index pin in its respective position at the respective end of said annular slot.

3. The seating arrangement according to claim 2, wherein said annular slot is an annular groove located in the bottom portion of one of said flanges of each frame, said flexible detent surfaces being ball detent screws installed on the bottom surface of said annular groove to engage said index pin.

4. The seating arrangement according to claim 3, wherein said flange with an annular groove has two of said annular grooves, said annular grooves being located on opposite portions of said flange, said index pin extending radially from said support pole on both sides of said support pole into both said annular grooves.

5. The seating arrangement according to claim 3, wherein said flange with an annular groove is the upper flange of each frame.

6. The seating arrangement according to claim 2, wherein said detent arrangement further comprises a detent spring ring, said annular slot being formed by said detent spring ring which is attached to the bottom portion of one of said flanges of each frame, said pair of flexible detent surfaces being located on a portion of said detent spring ring which is spaced from the bottom of the flange.

7. The seating arrangement of claim 6, wherein each said detent spring ring has two pairs of flexible detent surfaces in order to form two annular slots, the pairs of detent surfaces being located on opposite portions of said detent spring ring, said index pin extending radially from said support pole on both sides of said support pole into both said annular slots.

8. The seating arrangement according to claim 6, wherein said index pin is guided in said annular slot and is positioned in an axial space between a flat circular bottom portion of said flange with the attached detent spring ring and said flexible detent surfaces of the detent spring ring.

9. The seating arrangement according to claim 6, wherein said flange with the attached detent spring ring is the upper flange of each frame.

10. The seating arrangement according to claim 2, wherein said detent arrangement further comprises a pair of detent spring clips which are attached to the bottom portion of one of said flanges of each frame, said annular slot being an annular groove located in the bottom portion of said flange with the attached detent spring clips, said flexible detent surfaces being raised portions of said detent spring clips, said pair of detent spring clips being attached to opposite ends of said annular groove.

11. The seating arrangement according to claim 10, wherein said flange with an annular groove has two of said annular grooves, said annular grooves being located on opposite portions of said flange, said index pin extending radially from said support pole on both sides of said support pole into both said annular grooves.

12. The seating arrangement according to claim 10, wherein said flange with the attached detent spring clips is the upper flange of each frame.

13. A method of stowing a pair of seats, one seat having an upper frame with upper and lower flanges, said upper flange having a detent arrangement with a pair of flexible detent surfaces for separately engaging with an upper index pin attached to a circular support pole, the detent arrangement providing an annular slot in which said upper index pin passes, the other seat having a lower frame with upper and lower flanges, said upper flange of said lower frame having a second detent arrangement with a second pair of flexible detent surfaces for separately engaging a lower index pin attached to said support pole, said second detent arrangement providing a second annular slot in which said lower index pin passes, said flanges of said upper frame being mounted on said circular support pole above said flanges of said lower frame, the method comprising the steps of:

rotating one of said seats independently of the other seat out of one of an in-use or a stowed position in order to disengage the respective index pin from a respective flexible detent surface of said pair of flexible detent surfaces of said one of said seats;

further rotating said one of the seats to deflect the other flexible detent surface of said pair of detent surfaces out of the path of said respective index pin to place the seat in the other of the in-use or stowed positions, without requiring any upward or downward movement of the flanges;

leaving the seat in said other of the in-use or stowed positions until it is desired to return to the previous position.

14. A seating arrangement comprising:

two seats each having a frame having upper and lower circular flanges; and a circular support pole including an index pin;

said upper and lower flanges of one frame being configured to rest above said upper and lower flanges of said other frame, said flanges being concentric and rotatable about said support pole, each of said frames having detent mating surfaces configured to engage said index pin to resist rotation of the flanges about the support pole, thereby enabling independent positioning of one of said seats in one of an occupied and stowed position independent of said other seat, without requiring any upward or downward movement of the frames.

* * * * *